US011980253B2

(12) United States Patent
Peyton et al.

(10) Patent No.: US 11,980,253 B2
(45) **Date of Patent: *May 14, 2024**

(54) FOOTWEAR WITH COMPRESSIBLE FLUID-FILLED CHAMBER

(71) Applicant: NIKE, Inc., Beaverton, OR (US)

(72) Inventors: Lee D. Peyton, Tigard, OR (US); Dervin A. James, Hillsboro, OR (US); Zachary M. Elder, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 36 days.

This patent is subject to a terminal disclaimer.

(21) Appl. No.: 17/851,932

(22) Filed: Jun. 28, 2022

(65) Prior Publication Data

US 2022/0322791 A1 Oct. 13, 2022

Related U.S. Application Data

(63) Continuation of application No. 16/415,355, filed on May 17, 2019, now Pat. No. 11,399,597, which is a (Continued)

(51) Int. Cl.
*A43C 11/16* (2006.01)
*A43B 3/26* (2006.01)

(Continued)

(52) U.S. Cl.
CPC ..... *A43C 11/165* (2013.01); *A43B 3/26* (2013.01); *A43B 13/04* (2013.01); *A43B 13/12* (2013.01);

(Continued)

(58) Field of Classification Search
CPC ..... A43B 3/26; A43B 23/029; A43B 13/04; A43B 13/12; A43B 13/186; A43B 13/223;

(Continued)

(56) References Cited

U.S. PATENT DOCUMENTS 5,175,947 A 1/1993 Parracho
5,205,055 A 4/1993 Harrell (Continued)

FOREIGN PATENT DOCUMENTS

CN 102958395 A 3/2013
WO WO-9409662 A1 5/1994

(Continued)

OTHER PUBLICATIONS

International Searching Authority, International Search Report and Written Opinion for PCT Application No. PCT/US2016/045622, dated Nov. 7, 2016.

(Continued)

*Primary Examiner* — Jameson D Collier
(74) *Attorney, Agent, or Firm* — Honigman LLP; Matthew H. Szalach; Jonathan P. O'Brien

(57) ABSTRACT

Articles of footwear having an upper and a sole structure and methods of making the articles. The upper includes an adjustment system having a base element, a fluid-filled chamber, an adjusting element, an anchoring element, and a tensile strand. The adjusting element is positioned outward from the fluid-filled chamber. The anchoring element is secured to the base element and is spaced from the adjusting element. The tensile strand extends between the adjusting element and the anchoring element. The adjusting element is operable to change a tension placed upon the tensile strand.

18 Claims, 27 Drawing Sheets

Related U.S. Application Data continuation of application No. 15/227,632, filed on Aug. 3, 2016, now Pat. No. 10,327,515.

(60) Provisional application No. 62/201,772, filed on Aug. 6, 2015.

(51) Int. Cl.

| | |
|---|---|
| ***A43B 13/04*** | (2006.01) |
| ***A43B 13/12*** | (2006.01) |
| ***A43B 13/18*** | (2006.01) |
| ***A43B 13/22*** | (2006.01) |
| ***A43B 23/02*** | (2006.01) |
| ***A43B 23/07*** | (2006.01) |
| ***A43C 1/00*** | (2006.01) |

(52) U.S. Cl.

CPC ..... *A43B 13/186* (2013.01); *A43B 13/223* (2013.01); *A43B 23/029* (2013.01); *A43B 23/07* (2013.01); *A43C 1/00* (2013.01)

(58) Field of Classification Search

CPC . A43B 23/07; A43B 23/0295; A43B 23/0235; A43B 23/088; A43C 11/165; A43C 1/00; A43C 11/16; A43C 1/006

USPC ..... 36/50.1, 45, 51, 55, 71, 89, 93

See application file for complete search history.

(56) References Cited

U.S. PATENT DOCUMENTS

| | | | | |
|---|---|---|---|---|
| 5,430,961 | A | 7/1995 | Faulconer et al. | |
| 5,713,141 | A | 2/1998 | Mitchell et al. | |
| 5,952,065 | A | 9/1999 | Mitchell et al. | |
| 6,013,340 | A | 1/2000 | Bonk et al. | |
| 6,082,025 | A | 7/2000 | Bonk et al. | |
| 6,127,026 | A | 10/2000 | Bonk et al. | |
| 6,203,868 | B1 | 3/2001 | Bonk et al. | |
| 6,267,390 | B1 * | 7/2001 | Maravetz | A43C 1/06 36/119.1 |
| 6,321,465 | B1 | 11/2001 | Bonk et al. | |
| 6,543,159 | B1 * | 4/2003 | Carpenter | A43C 11/1493 36/88 |
| 6,655,050 | B1 | 12/2003 | Lowe | |
| 2003/0056399 | A1 | 3/2003 | Baek | |
| 2005/0022427 | A1 | 2/2005 | Kerns et al. | |
| 2009/0272013 | A1 | 11/2009 | Beers et al. | |
| 2014/0157624 | A1 | 6/2014 | Girard et al. | |
| 2014/0283412 | A1 | 9/2014 | Elder et al. | |
| 2014/0338227 | A1 | 11/2014 | Gerber et al. | |
| 2015/0351488 | A1 | 12/2015 | Davis et al. | |

FOREIGN PATENT DOCUMENTS

| | | | |
|---|---|---|---|
| WO | WO-9500046 | A1 | 1/1995 |
| WO | WO-0076602 | A2 | 12/2000 |
| WO | WO-2017024166 | A1 | 2/2017 |
| WO | WO-2017160966 | A1 | 9/2017 |

OTHER PUBLICATIONS

United States Patent and Trademark Office, Office Action for U.S. Appl. No. 15/227,632, dated Jul. 20, 2018.

European Patent Office (ISA), International Preliminary Report on Patentability for PCT Application No. PCT/US2016/045622, dated Feb. 6, 2018.

China National Intellectual Property Office, Office Action for CN Application No. 201680054011.5, dated Feb. 3, 2020.

European Patent Office, Extended European Search Report for application No. 21216379.4 dated Jul. 20, 2022.

* cited by examiner

FOOTWEAR WITH COMPRESSIBLE FLUID-FILLED CHAMBER

CROSS-REFERENCE TO RELATED APPLICATIONS

This application is a continuation of U.S. patent application Ser. No. 16/415,355, filed May 17, 2019, which is a continuation of U.S. patent application Ser. No. 15/227,632, filed Aug. 3, 2016, which claims the benefit of U.S. Provisional Patent Application No. 62/201,772, filed Aug. 6, 2015, entitled "Footwear With Compressible Fluid-Filled Chamber," the disclosures of which are incorporated herein by reference in their entirety.

FIELD

The present disclosure relates generally to articles of footwear.

BACKGROUND

A conventional article of footwear may include an upper and a sole structure. The upper may define a void that securely receives the foot of a wearer and positions it with respect to the sole structure. The sole structure may be secured to a lower surface of the upper. A sole structure may include a fluid-filled chamber. The upper may be formed to include a gap between medial and lateral sides in an instep area of the footwear. The gap may be bridged by a lace, and a tongue may extend under the gap. The lace may be loosened to facilitate the insertion of a wearer's foot into the footwear. Once the wearer's foot is in place within the footwear, the lace may be tightened and tied in order to better secure the upper against the wearer's foot.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DESCRIPTION

Figure 1:
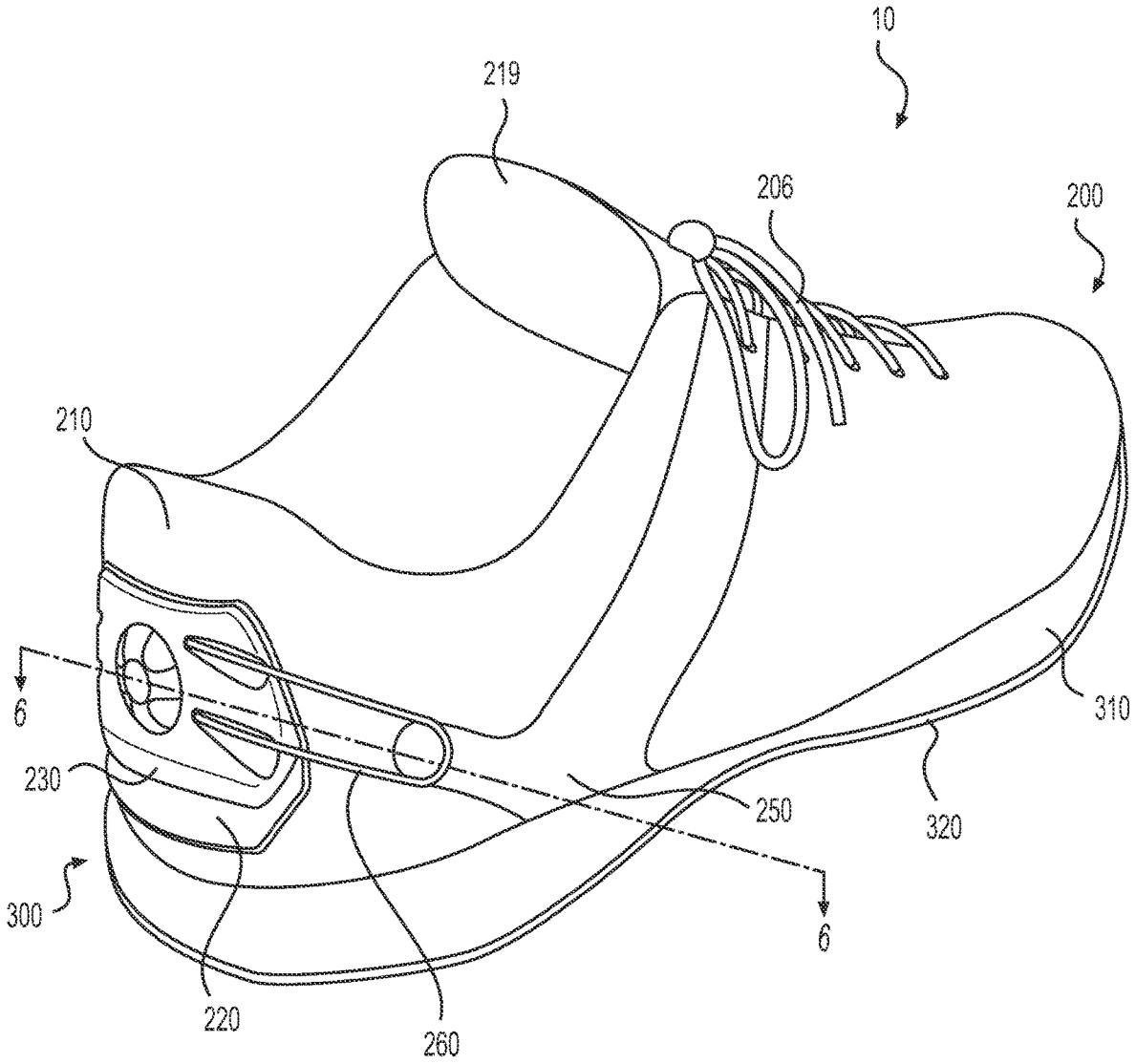
FIG. 1 is a lateral side perspective view of an embodiment of an article of footwear.

An article of footwear may have various parts subject to improvement. As previously described, a conventional article of footwear may include an upper and a sole structure. The upper may be formed from one or more of a variety of material elements (e.g. textiles, leather, synthetic leather, and foam materials), and may define a void that securely receives the foot of a wearer and positions it with respect to the sole structure. The sole structure may be secured to a lower surface of the upper, and may have a layered configuration that includes a comfort-enhancing insole, a resilient midsole formed from a polymer foam, and a ground-contacting outsole.

A polymer foam material within a sole structure may include a plurality of open or closed cells that deteriorate following repeated compressions. The effects of this deterioration may be decreased by incorporating a fluid-filled chamber into the sole structure. The chamber may be formed from a polymer material that is sealed to enclose a fluid, and may be encapsulated within the polymer material, or may be located above or below it, or may form any portion of the midsole. Fluid-filled chambers suitable for such footwear applications may be manufactured by thermoforming techniques.

The sole structure may serve to attenuate ground reaction forces, to provide traction, and to control various foot motions such as pronation. The upper and the sole structure may cooperatively provide a comfortable structure to benefit a wearer engaged in any of a variety of activities.

The upper may be formed to include a gap between medial and lateral sides in an instep area of the footwear. The gap may be bridged by a lace, and a tongue may extend under the gap. The lace may be loosened to facilitate the insertion of a wearer's foot into the footwear. Once the wearer's foot is in place within the footwear, the lace may be tightened and tied in order to better secure the upper against the wearer's foot.

In some cases, a conventional lace may be insufficient for addressing a design need, or may be undesirable. For example, for some footwear, it may be desirable to secure an area of the footwear other than the instep area against a wearer's foot. At the same time, it may be desirable to present a simpler means of securing the footwear against the wearer's foot. It may also be desirable to pre-define the shape of the instep area in ways that may be obstructed or hindered by conventional tongues and laces. In addition, it may be desirable to provide cushioning or other protection to an area of the footwear that is secured against the wearer's foot.

Therefore, there exists a need in the footwear art for improvements that permit alternate placement of the means of securing footwear against a foot, that simplify the use of those securing means, that minimize distortion of pre-defined shapes of the upper, and that provide protection against impacts to the area of the footwear being secured against the foot.

Articles of footwear with improved means of securing the footwear against a wearer's foot are described herein. The improvements permit alternate placement of the securing means, such as in an Achilles tendon are of a heel region of the footwear. The improvements also provide simplified securing means, through the use of a dial. The securing means may permit a reduction or elimination of conventional means for securing footwear against feet, such as tongues and laces, and thereby reduce distortion of a pre-defined shape of the upper. In addition, the improvements provide protection to the area of the footwear being secured against the foot.

In one aspect an article of footwear having an upper and an outsole is provided. The article comprises a fluid-filled chamber, and adjusting element, an anchoring element, and a tensile strand. The adjusting element is positioned outward from the fluid-filled chamber. The anchoring element is secured to the base element and is spaced from the adjusting element. The tensile strand extends between the adjusting element and the anchoring element. The adjusting element is operable to change a tension placed on the tensile strand.

In some embodiments, the article comprises a base element that extends from a heel region of the article to a forefoot region of the article and extends from a medial side of the article to a lateral side of the article.

In some embodiments, the fluid-filled chamber is positioned in a heel region of the article, the adjusting element is positioned in a heel region of the article and to the rear of the fluid-filled chamber, and the anchoring element is positioned on the base element and in front of the adjusting element.

In another aspect a method of making an article of footwear having an upper and an outsole is provided. In one step, the method comprises providing a upper, a fluid-filled chamber and an outsole. In another step, the method comprises positioning an adjusting element outward from the fluid-filled chamber. In another step, the method comprises securing an anchoring element to the upper at a position spaced from the adjusting element. In another step, the method comprises positioning a tensile strand to extend between the adjusting element and the anchoring element. The adjusting element is configured operable to change a tension placed on the tensile strand.

Other systems, methods, features and advantages will be, or will become, apparent to one of ordinary skill in the art upon examination of the following figures and detailed description. It is intended that all such additional systems, methods, features and advantages be included within this description, be within the scope of the invention, and be protected by the following claims.

The following discussion and accompanying figures disclose articles of footwear having fluid-filled chambers, adjusting elements, and anchoring elements. The articles of footwear are disclosed as having a general configuration suitable for walking or running. However, concepts associated with the footwear may be applied to a variety of other footwear types, including footwear for athletic activities such as baseball, basketball, football, soccer, tennis, golf, cycling, cross-training, and hiking, for example. Associated concepts may also be utilized with a variety of footwear styles generally considered to be casual or non-athletic, such as work boots, dress shoes, loafers, and sandals. Accordingly, the concepts disclosed herein apply to a wide variety of footwear types.

General Footwear Structure

An article of footwear 10 designed for a wearer's right foot is depicted in FIGS. 1-6. Article of footwear 10 includes an upper 200 for receiving the foot and a sole structure 300.

Figure 3:
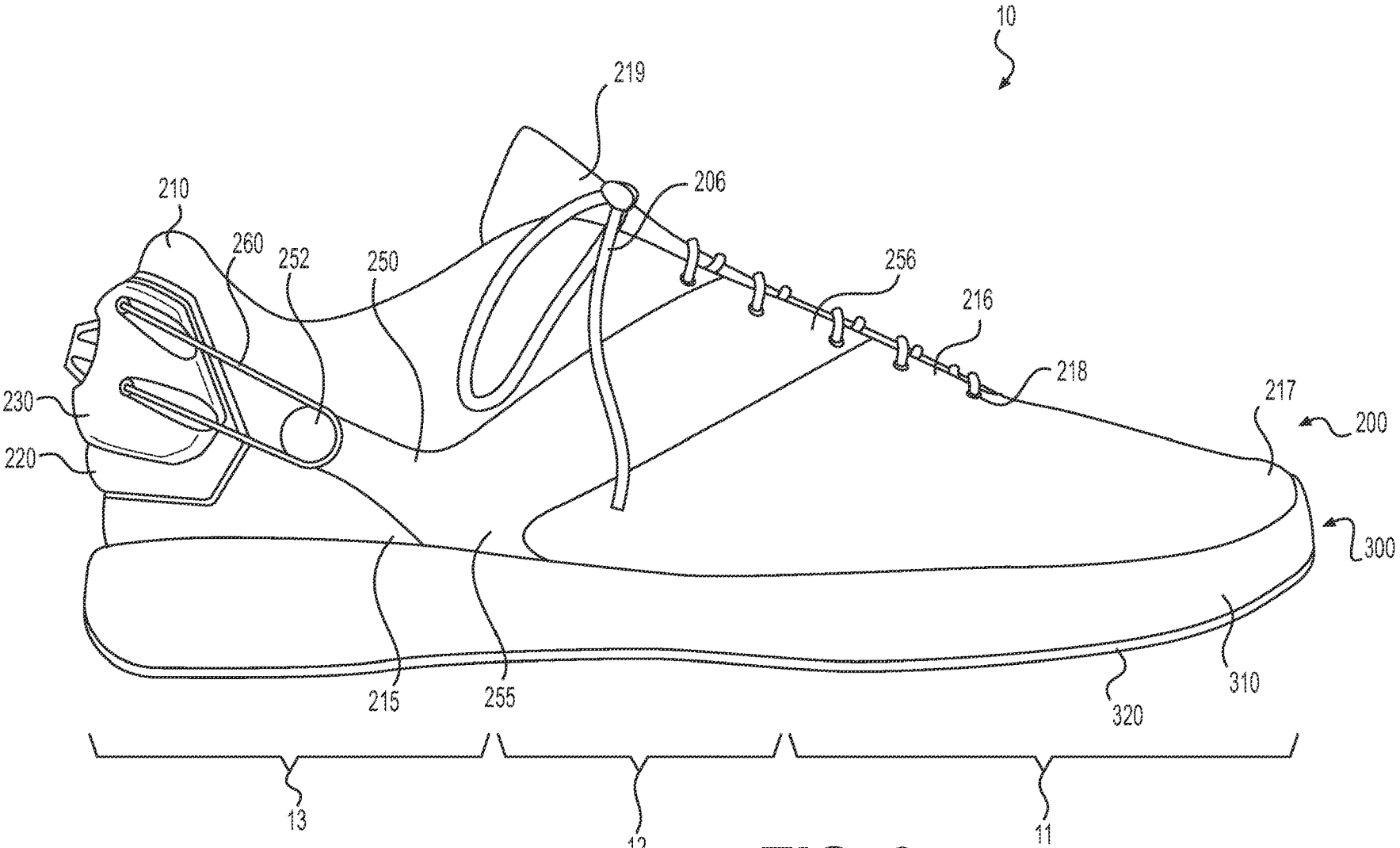
FIG. 3 is a lateral side elevational view of the article of footwear.

For reference purposes, footwear 10 may be divided into three general regions: a forefoot region 11, a midfoot region 12, and a heel region 13, as shown in FIG. 3. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone.

Figure 4:
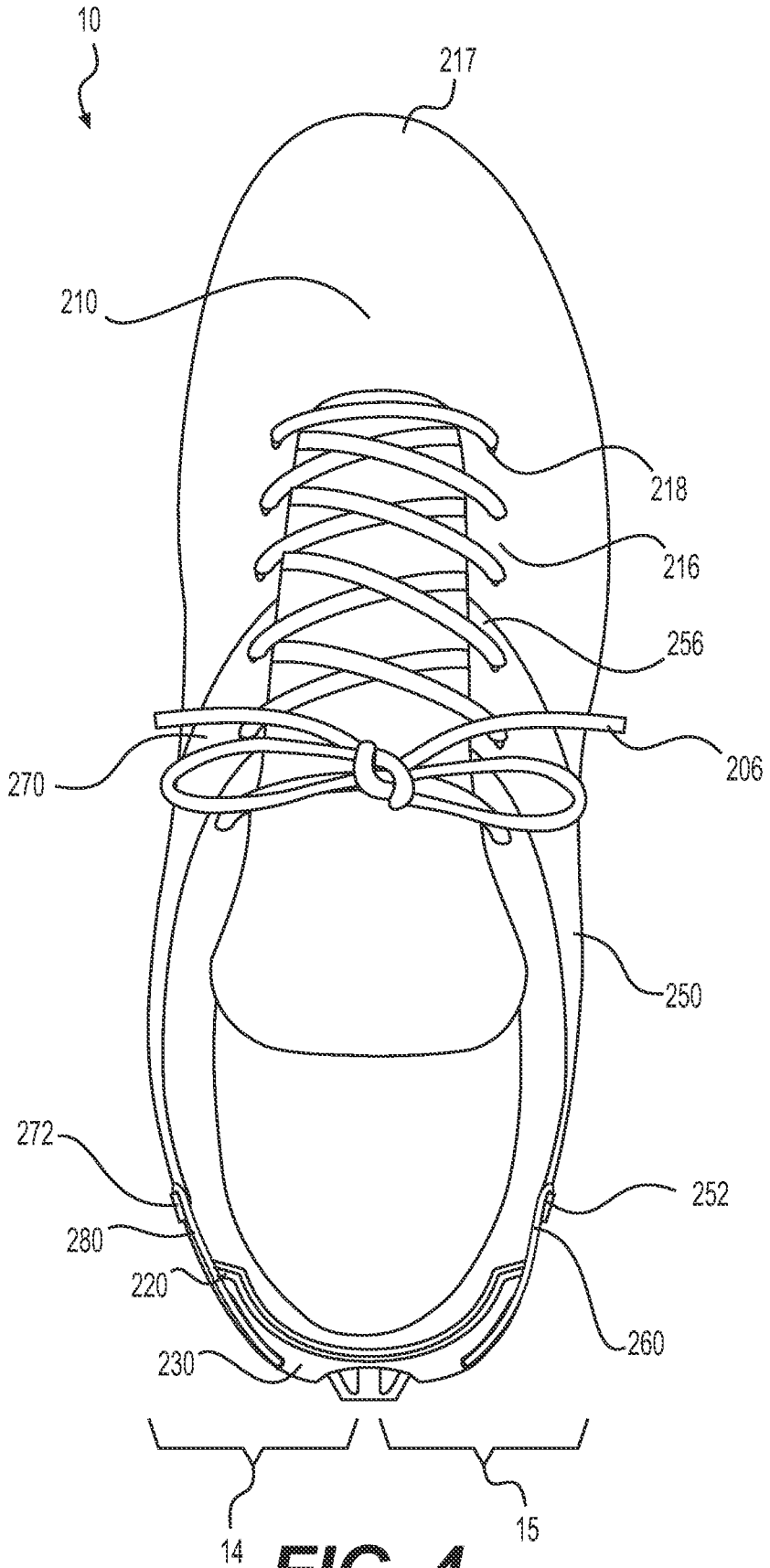
FIG. 4 is a top view of the article of footwear.
Figure 5:
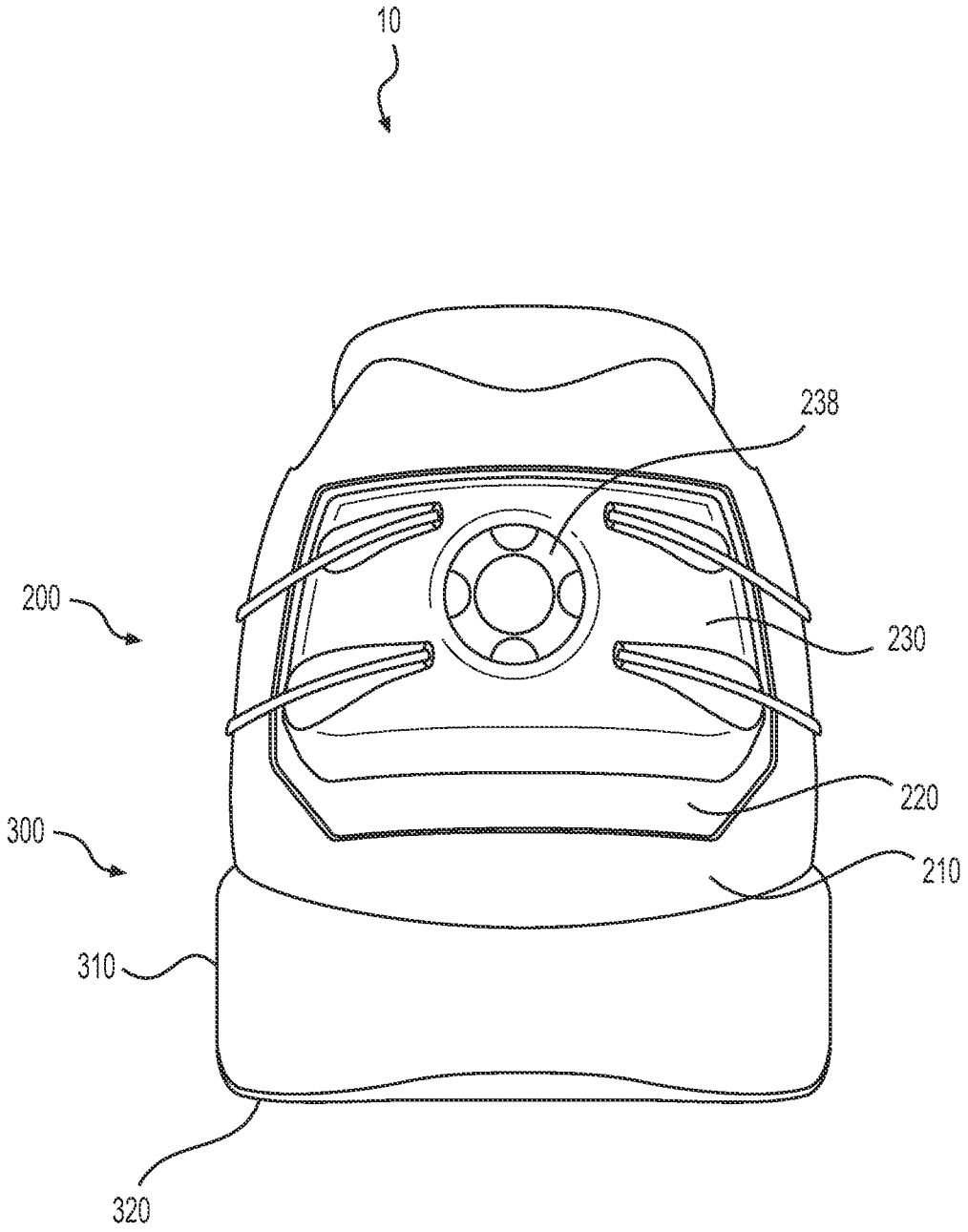
FIG. 5 is a rear elevational view of the article of footwear.
Figure 6:
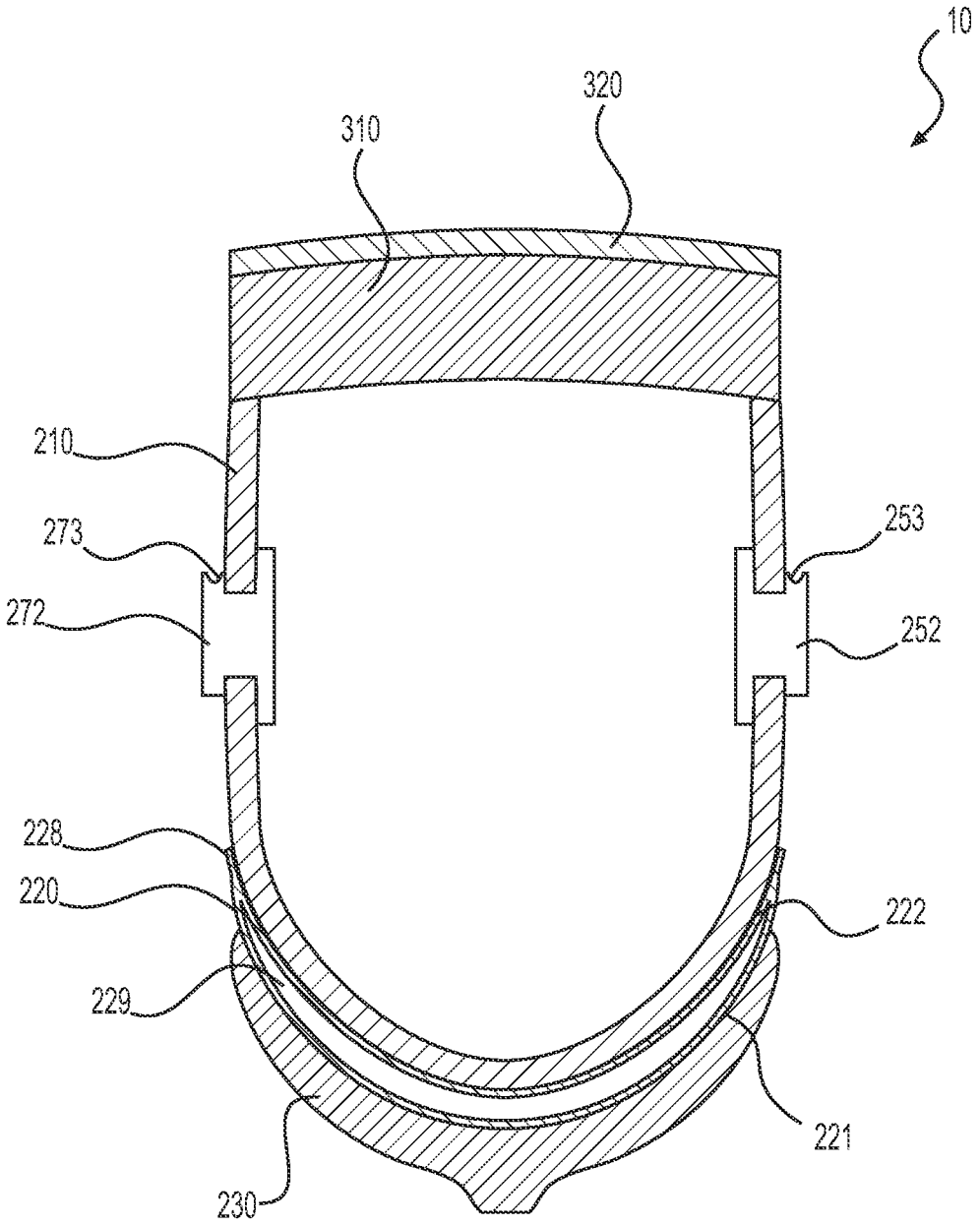
FIG. 6 is a cut-away view of the article of footwear, as defined by section line 6-6 in FIG. 1.
Figure 7:
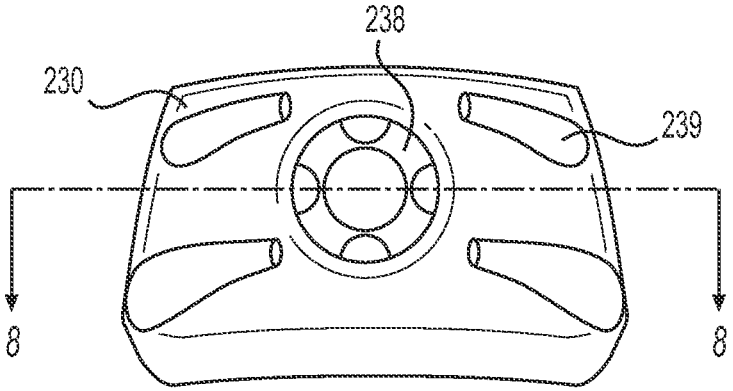
FIG. 7 is a rear elevational view of an adjusting element of the article of footwear.
Figure 8:
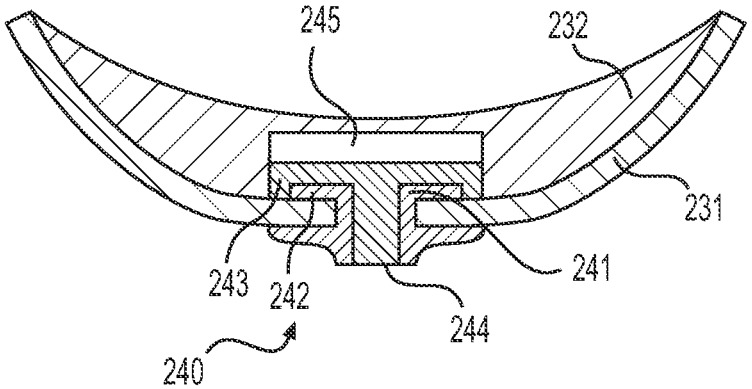
FIG. 8 is a cross-sectional view of the adjusting element, as defined by section line 8-8 in FIG. 7.

Footwear 10 also includes a medial side 14 and a lateral side 15, as shown in FIG. 4. Medial side 14 and lateral side 15 extend through each of regions 11-13 and correspond with opposite sides of footwear 10.

Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 200, sole structure 300, and individual elements thereof.

Upper 200 includes a base element 210 extending from forefoot region 11 to heel region 13, and extending from medial side 14 to lateral side 15. Base element 210 may have a substantially conventional configuration incorporating a plurality of material elements (e.g., textile, polymer, foam, leather, and synthetic leather) that are stitched, adhered, bonded, or otherwise joined together to form an interior void for securely and comfortably receiving the wearer's foot. The material elements may be selected and arranged in order to selectively impart properties of durability, air-permeability, wear-resistance, flexibility, and comfort, for example. Upper 200 may additionally incorporate a sockliner beneath the interior void to enhance the comfort of footwear 10. The void is shaped to accommodate the foot and extends along the lateral side of the foot, along the medial side of the foot, over the foot, around the heel, and under the foot. An ankle opening in heel region 13 provides access to the interior void.

Upper 200 also includes a lace 206 that extends through various lace apertures 218 formed in a lace area 216 of base element 210. However, in some configurations, upper 200 may incorporate other structures that are functionally similar to lace 206, such as a hook-and-loop fastening system. Furthermore, as an alternative to lace apertures 218, upper 200 may include other lace-receiving elements, such as loops, eyelets, and D-rings. Base element 210 also includes a tongue 219 extending between the interior void and lace 206.

Lace 206 may be utilized in a conventional manner to modify the dimensions of base element 210 and the interior void. More particularly, lace 206 permits the wearer to tighten upper 200 around the foot and to loosen upper 200, in order to facilitate entry and removal of the foot from the interior void. Lace 206 and tongue 219 may accordingly be adjusted to secure the foot within footwear 10.

Sole structure 300 is secured to upper 200 and has a configuration that extends between upper 200 and the ground, and thus effectively extends between the foot and the ground. Sole structure 300 may include a midsole 310 formed from a polymer foam material, such as polyurethane or ethylvinylacetate. Sole structure 300 may also include an outsole 320 secured to a lower surface of midsole 310. Outsole 320 may be formed from a material that provides a durable and wear-resistant surface for engaging the ground, and may be textured to enhance the traction (i.e., friction) properties between footwear 10 and the ground, such as rubber materials. Outsole 320 may accordingly form a ground-contacting surface of footwear 10. In addition, sole structure 300 may incorporate one or more footwear elements that enhance the comfort, performance, or ground reaction force attenuation properties of footwear 10, including fluid-filled chambers, plates, moderators, lasting elements, or motion control members. Sole structure 300 may accordingly attenuate ground reaction forces, provide cushioning for the foot, provide traction, impart stability, and limit various foot motions, such as pronation.

Adjustment System Configuration

As depicted in FIGS. 1-6, upper 200 also includes an adjustment system having various elements: a fluid-filled chamber 220, an adjusting element 230, an anchoring element 250, and a tensile strand 260. Fluid-filled chamber 220 is positioned along an exterior surface of base element 210, adjusting element 230 is positioned outward from chamber 220, and anchoring element 250 is secured to base element 210 at a position spaced from adjusting element 230. More particularly, as depicted in FIGS. 1-6: (a) chamber 220 is positioned in heel region 13 of footwear 10, in an Achilles tendon area of base element 210; (b) adjusting element 230 is positioned in heel region 13 of footwear 10 and to the rear of chamber 220; and (c) anchoring element 250 is positioned on base element 210 and in front of adjusting element 230. Tensile strand 260 extends between adjusting element 230 and anchoring element 250.

Fluid-filled chamber 220 is depicted as being secured against an exterior surface of base element 210. Fluid-filled chamber 220 has a first, outward-facing portion 221 oriented to face toward an exterior of footwear 10 and a second, inward-facing portion 222 oriented to face toward an interior of footwear 10.

In some configurations, chamber 220 may be secured to base element 210 by an adhesive. In other configurations, chamber 220 may be otherwise secured to base element 210. For example, chamber 220 may be secured to base element 210 by a polymer bond, in which a polymer material of chamber 220 may physically intermingle with a material of base element 210 (such as by being partially softened or melted when pressed against base element 210). In other configurations, chamber 220 may be secured to base element 210 by a hook-and-loop fastening system.

Outward-facing portion 221 and inward-facing portion 222 of fluid-filled chamber 220 may be formed from two layers of a polymer material that are sealed to enclose a pressurized fluid 229, and may accordingly form an outer barrier 228 of chamber 220. More specifically, in manufacturing fluid-filled chamber 220, a pair of polymer sheets may be molded during a thermoforming process to define outward-facing portion 221 and inward-facing portion 222. The thermoforming process may (a) impart shape to the polymer sheets to form chamber 220, and (b) may form a bonded portion extending around a periphery of chamber 220.

A wide range of polymer materials may be utilized for forming chamber 220. In selecting a material, engineering properties of the material (e.g., tensile strength, stretch properties, fatigue characteristics, dynamic modulus, and loss tangent) as well as the ability of the material to prevent the diffusion of the fluid contained by layers 28 and 29 may be considered. When formed of thermoplastic urethane, for example, portions 221 and 222 may have a thickness of approximately 1.0 millimeter, but the thickness may range from 0.25 to 2.0 millimeters or more, for example. In addition to thermoplastic urethane, examples of polymer materials that may be suitable for chamber 220 include polyurethane, polyester, polyester polyurethane, and polyether polyurethane. Portions 221 and 222 may also be formed from a material that includes alternating layers of thermoplastic polyurethane and ethylene-vinyl alcohol copolymer, as disclosed in U.S. Pat. Nos. 5,713,141 and 5,952,065 to Mitchell, et al, the entire disclosures of which are hereby incorporated by reference. A variation upon this material may also be utilized, wherein a center layer is formed of ethylene-vinyl alcohol copolymer, layers adjacent to the center layer are formed of thermoplastic polyurethane, and outer layers are formed of a regrind material of thermoplastic polyurethane and ethylene-vinyl alcohol copolymer. Another suitable material for layers 28 and 29 is a flexible microlayer membrane that includes alternating layers of a gas barrier material and an elastomeric material, as disclosed in U.S. Pat. Nos. 6,082,025 and 6,127,026 to Bonk, et al. Further suitable materials include polyurethane including a polyester polyol, as disclosed in U.S. Pat. Nos. 6,013,340, 6,203,868, and 6,321,465 to Bonk, et al, the entire disclosures of which are hereby incorporated by reference.

Adjusting element 230 is depicted as being secured against fluid-filled chamber element 220. Adjusting element 230 has a first, outward-facing portion 231 oriented to face an exterior of footwear 10 and a second, inward-facing portion 232 oriented to face toward an interior of footwear 10. Inward-facing portion 232 of adjusting element 230 and outward-facing portion 221 of chamber 220 directly contact each other. Accordingly, adjusting element 230 and chamber 220 are in direct contact with each other. However, in other configurations, footwear 10 may incorporate a material interposed between adjusting element 230 and chamber 220, and they may not be in direct contact with each other.

Figure 2:
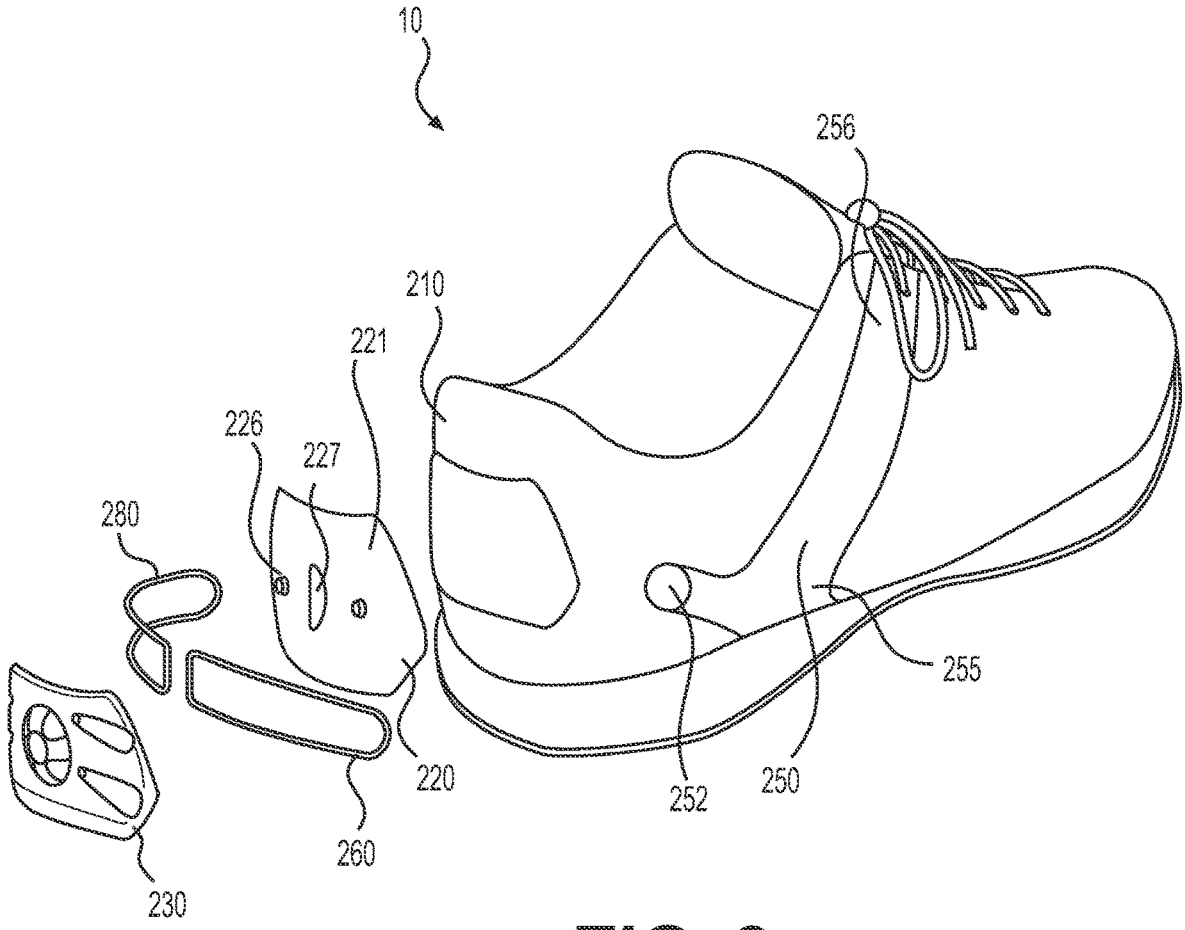
FIG. 2 is an exploded lateral side perspective view of a rear portion of the article of footwear.

Inward-facing portion 232 of adjusting element 230 and outward-facing portion 221 of chamber 220 are also shaped to conform to each other. In some configurations, inward-facing portion 232 and outward-facing portion 221 may be include localized features that conform to each other. For example, as shown in FIG. 2, outward-facing portion 221 of chamber 220 is formed to include various protrusions 226 and indentations 227. Similarly, inward-facing portion 232 of adjusting element 230 is formed to include various protrusions 236 and indentations 237 which respectively complement indentations 227 and protrusions 226 of outward-facing portion 221. Accordingly, outward-facing portion 221 and inward-facing portion 232 may be formed to have contours conforming to each other, which may advantageously help to align the position of adjusting element 230 with respect to chamber 220. Adjusting element 230 includes a dial element 238, which may be coupled to a ratchet structure 240 as discussed below.

Anchoring element 250 is secured to base element 210 in midfoot region 12, on lateral side 15 of footwear 10.

Anchoring element 250 includes a connecting portion 252, a biteline portion 255 extending from connecting portion 252 to a biteline area 215 of base element 210, and a lace area portion 256 extending from connecting portion 252 to lace area 216 of base element 210. A guide channel 253 is formed in a part of a periphery of connecting portion 252 that is spaced furthest from adjusting element 230. In some embodiments, guide channel 253 may not be open or otherwise exposed to an exterior of connecting portion 252, but may be enclosed within connecting portion 252.

In some configurations, anchoring element 250 may have an alternate extent. For example, anchoring element 250 may extend only to biteline area 215, or may extend only to lace area 216. In other configurations, anchoring element 250 may extend to a toe area 217 of base element 210. In various configurations, anchoring element 250 may have portions extending to any of a variety of areas along base element 210 that are spaced from adjusting element 230.

Anchoring element 250 may incorporate one or more material elements similar to the material elements that may be incorporated into base element 210 (e.g., textile, polymer, foam, leather, and synthetic leather). Anchoring element 250 may be stitched, adhered, bonded, or otherwise joined to base element 210. Base element 210 may exhibit a first degree of stretch under a tension, and anchoring element 250 may exhibit a second, lesser degree of stretch under the same tension.

As depicted in FIGS. 1-6, connecting portion 252 of anchoring element 250 has a substantially circular shape. However, connecting portion 252 may have any of a variety of regular or irregular shapes. Similarly, guide channel 253 has a substantially semi-circular cross-sectional shape, but guide channel 253 could have any of a variety of regular or irregular cross-sectional shapes. For embodiments in which guide channel 253 is enclosed within connecting portion 252, guide channel 253 may have a substantially circular cross-sectional shape, or any of a variety of regular or irregular cross-sectional shapes.

Connecting portion 252 may include any of a variety of materials. In some configurations, connecting portion 252 may include a polymer material. In other configurations, connecting portion 252 may include a rubber material, a metal material, a wood material, or a composite material, such as a composite-fiber material. Moreover, connecting portion 252 may be formed entirely of a polymer material, a rubber material, a metal material, a wood material, or a composite material.

In some configurations, anchoring element 250 may not have biteline portion 255, lace area portion 256, or any other portions extending from connecting portion 252 to various areas of base element 210. In such configurations, anchoring element 250 may only consist of connecting portion 252, which may be secured to base element 210. In still further configurations, anchoring element 250 may be a single, continuous element unitarily formed as a single piece. That is, connecting portion 252 and other portions of anchoring element 250, such as biteline portion 255 and lace area portion 256, may be a continuous, unitarily-formed, single-piece element.

Tensile strand 260 extends between adjusting element 230 and anchoring element 250 on lateral side 15 of footwear 10. More specifically, tensile strand 260 extends between adjusting element 230 and connecting portion 252 of anchoring element 250. A first portion 261 of tensile strand 260 extends through channels 239 formed in outward-facing portion 231 of adjusting element 230 and into adjusting element 230, while a second portion 262 of tensile strand 260 is positioned within guide channel 253 of anchoring element 250, and extends around a part of the periphery of connecting portion 252 that is spaced furthest from adjusting element 230.

Tensile strand 260 may be formed from any generally one-dimensional material. As utilized with respect to the present invention, the term "one-dimensional material" or variants thereof is intended to encompass generally elongate materials exhibiting a length that is substantially greater than a width and a thickness. Accordingly, suitable configurations for tensile strand 260 include various filaments, fibers, yarns, threads, and cables that are formed from one or more of rayon, nylon, polyester, polyacrylic, silk, cotton, carbon, glass, aramids (e.g., para-aramid fibers and meta-aramid fibers), ultra high molecular weight polyethylene, liquid crystal polymer, and various metals. Although one-dimensional materials will often have a cross-section where width and thickness are substantially equal (e.g., a round or square cross-section), some one-dimensional materials may have a width that is greater than a thickness (e.g., a rectangular, oval, or otherwise elongate cross-section). Despite the greater width, a material may be considered one-dimensional if a length of the material is substantially greater than a width and a thickness of the material.

FIGS. 1-6 depicts additional elements of the adjustment system: (a) an additional anchoring element 270 secured to base element 210 in midfoot region 12, on medial side 14 of footwear 10; and (b) an additional tensile strand 280 extending between adjusting element 230 and additional anchoring element 270 on medial side 14 of footwear 10. Additional anchoring element 270 is positioned on medial side 14, opposite anchoring element 250 on lateral side 15, and includes a connecting portion 272 with a guide channel 273, a biteline portion 275, and a lace area portion 276. Similarly, additional tensile strand 280 is positioned on medial side 14, opposite tensile strand 260 on lateral side 15, and includes a first portion 281 and a second portion 282.

As mentioned above, and with reference to FIGS. 7-11, dial element 238 of adjusting element 230 may be coupled to ratchet structure 240. More particularly, outward-facing portion 231 and an inward-facing portion 232 of adjusting element 230 may define an internal cavity 245 containing various portions of ratchet structure 240. Ratchet structure 240 may be positioned partially within cavity 245 of adjusting element 230, and dial element 238 may be positioned on an outward-facing surface of adjusting element 230 and may be externally-accessible to a wearer.

In one embodiment, ratchet structure 240 may include a spool portion 241, a gear portion 242, a pawl portion 243, and a release portion 244. At least spool portion 241 and gear portion 242 may be connected to a peripheral portion of dial element 238, so that an adjustment of dial element 238 away from an initial position will rotate spool portion 241 and gear portion 242. In contrast, pawl portion 243 may be separate from the peripheral portion of dial element 238. Accordingly, an adjustment of dial element 238 will not rotate pawl portion 243.

Pawl portion 243 may have one or more pawls configured to interlock with the teeth of gear portion 242. Pawl portion 243 may accordingly permit an adjustment of gear portion 242 (and spool portion 241) in one direction, but not another.

Meanwhile, first portion 261 of tensile strand 260 may be positionally secured to spool portion 241 of ratchet structure 240. First portion 261 may be adhesively or mechanically secured to spool portion 241, or may extend through part of spool portion 241.

Adjustment System Operation

Figure 12:
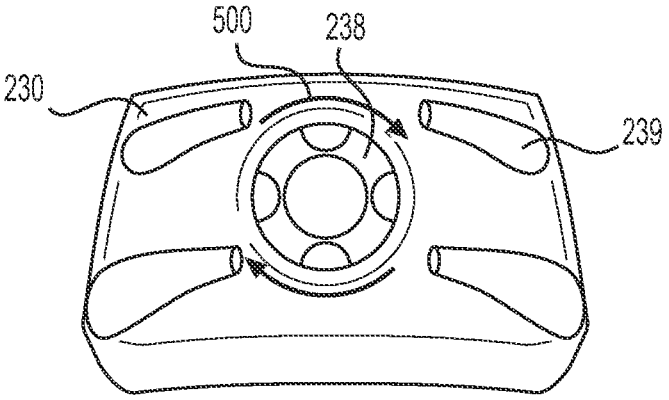
FIG. 12 is a rear elevational view of the adjusting element of the article of footwear before an adjustment.

As depicted in FIG. 12, dial element 238 is set to a first setting, and adjustment 500 is applied to dial element 238 in a clockwise direction. In response, within ratchet structure 240, pawl portion 243 permits the adjustment of gear portion 242, and gear portion 242 (and spool portion 241) rotate in a clockwise direction. Since first portion 261 of tensile strand 260 is secured to spool portion 241, tensile strand 260 is partially wound about spool portion 241, and a tension is in turn placed on tensile strand 260 between first portion 261 and second portion 262.

Figure 9:
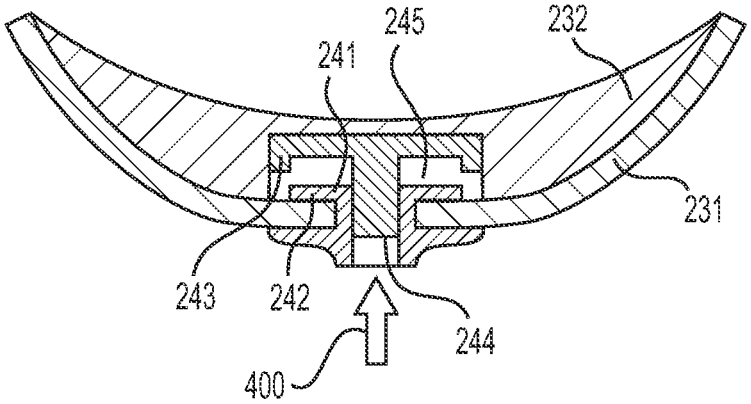
FIG. 9 is a cross-sectional view corresponding with FIG. 8 and depicting the application of a force to a release portion of the adjusting element.
Figure 10:
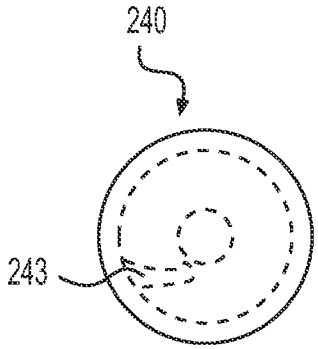
FIG. 10 is a front plan view of a first part of a ratchet structure of the adjusting element.
Figure 11:
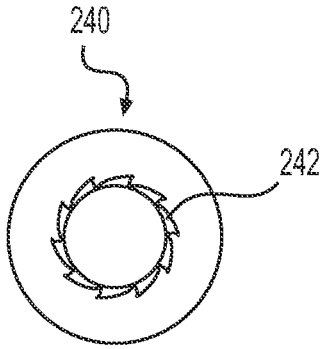
FIG. 11 is a front plan view of a second part of the ratchet structure.
Figure 13:
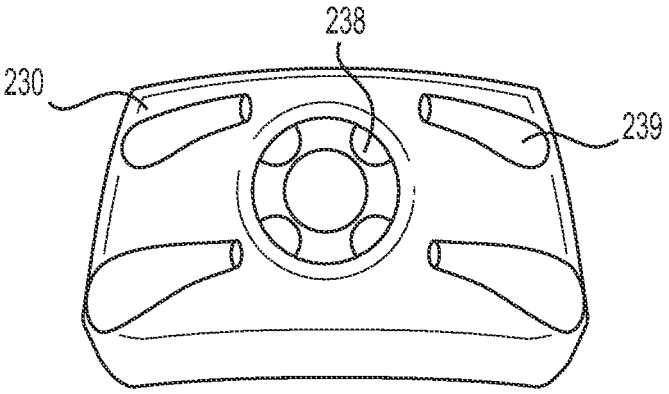
FIG. 13 is a rear elevational view of the adjusting element of the article of footwear after the adjustment.

After adjustment 500 has been applied, as depicted in FIG. 13, dial element 238 is set to a second setting, in which pawl portion 243 does not permit the rotation of gear portion 242 in a counterclockwise direction. As a result, dial element 238 remains set to the second setting. An application of an inwardly-directed release force 400 on release portion 244 (as shown in FIG. 9) may subsequently disengage gear portion 242 from pawl portion 243, permitting dial element 238 to freely rotate back toward its first setting.

Due to the adjustment of dial element 238, adjusting element 230 is accordingly operable to change a tension placed upon tensile strand 260. In turn, the tension placed upon strand 260 may urge adjusting element 230 toward connecting portion 252 of anchoring element 250, which will in turn place a compressive force upon fluid-filled chamber 220. Thus, an adjustment of dial element 238 may urge a rear area of heel region 13 against a rear portion of a foot of a wearer, which may better secure footwear 10 to a wearer's foot by causing fluid-filled chamber 220 to conform to the wearer's foot, and by urging the wearer's foot forward within footwear 10.

Figure 14:
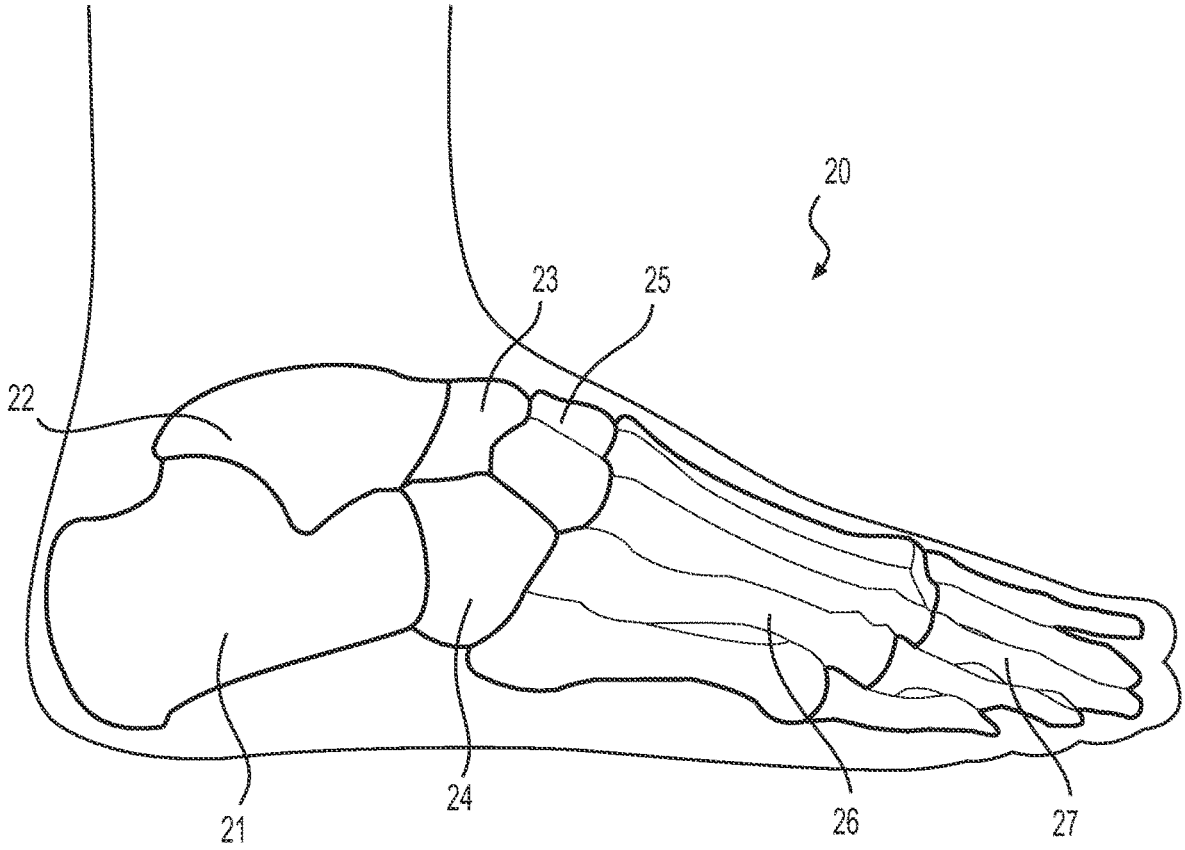
FIG. 14 is a lateral side elevational view of a foot of a wearer.

With reference to FIG. 14, a wearer's foot 20 includes a calcaneus 21, a talus bone 22, a navicular bone 23, a cuboid bone 24, cuneiform bones 25, metatarsal bones 26, and phalanges 27. When footwear 10 is positioned on foot 20, connecting portion 252 is located in front of adjusting element 230 at a position (along an anteroposterior axis) corresponding with an anterior end of talus bone 22 and an anterior end of calcaneus 21 of the wearer's foot 20. Accordingly, an adjustment of adjusting element 230 may advantageously urge portions of base element 210 in front of connection portion 252 against portions of foot 20 containing the numerous soft tissues associated with phalanges 27, metatarsal bones 26, cuneiform bones 25, cuboid bone 24, and navicular bone 23. Footwear 10 may thus be urged against portions of foot 20 that may most flexibly respond to the shape of footwear 10.

The inclusion of the adjustment system may advantageously permit alternate placement of a means of securing footwear 10 against a foot. In addition, the inclusion of dial element 238 may advantageously simplify a means of securing footwear 10 against the foot. Moreover, the inclusion of the adjustment system may accommodate configurations of footwear 10 in which (a) base element 210 does not have a tongue 219, (b) base element 210 does not have a lace area 216 with lace apertures 218, and (c) upper 200 does not have a lace 206. Portions of footwear 10 which may lead to a distortion of a pre-defined shape of upper 200 may accordingly be minimized. Adjusting element 230 and fluid-filled chamber 220 may also advantageously provide cushioning and protection to an area of footwear 10 (i.e., heel region 13) that is secured against a wearer's foot.

Methods of Manufacturing

Figure 15:
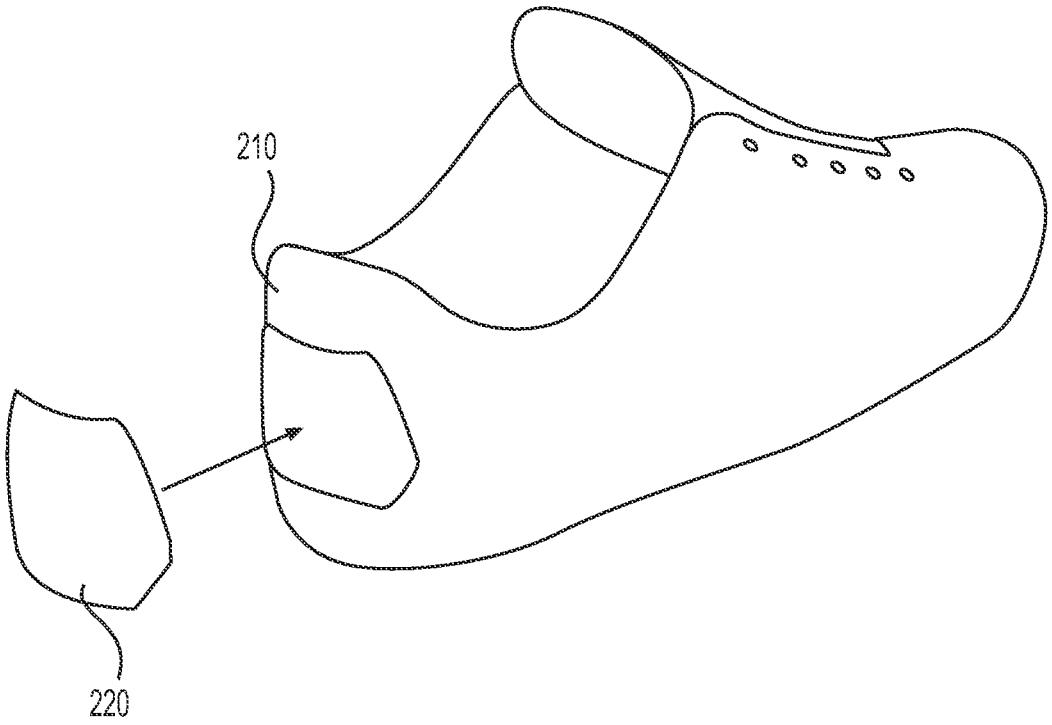
FIGS. 15-20 are lateral side perspective views depicting steps in the manufacture of an embodiment of an article of footwear.
Figure 16:
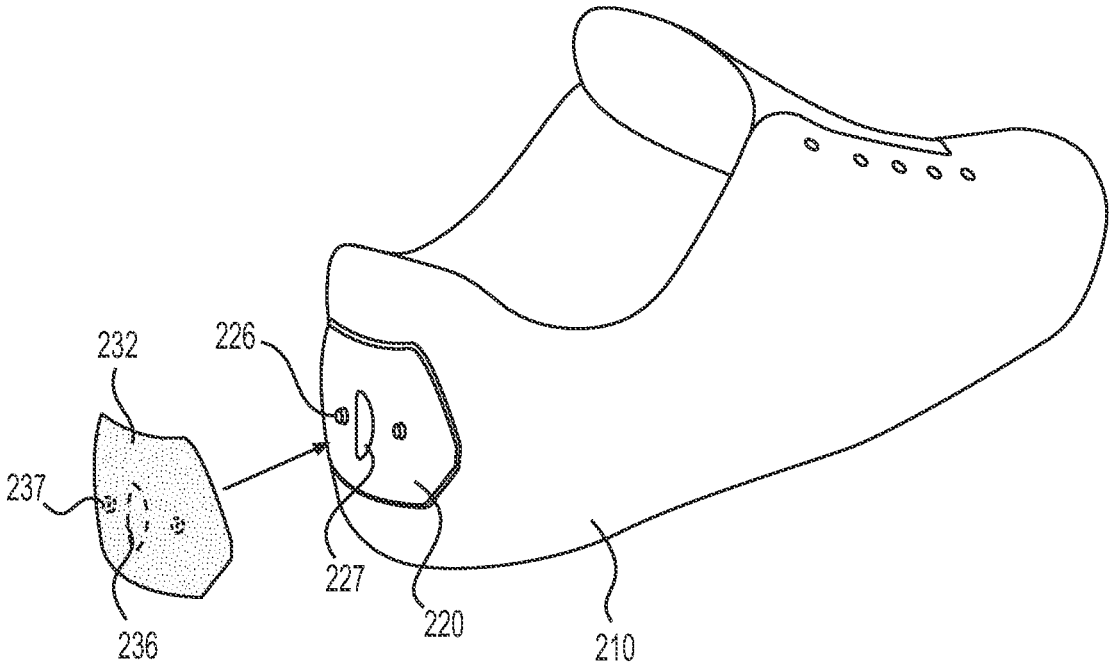
Figure 17:
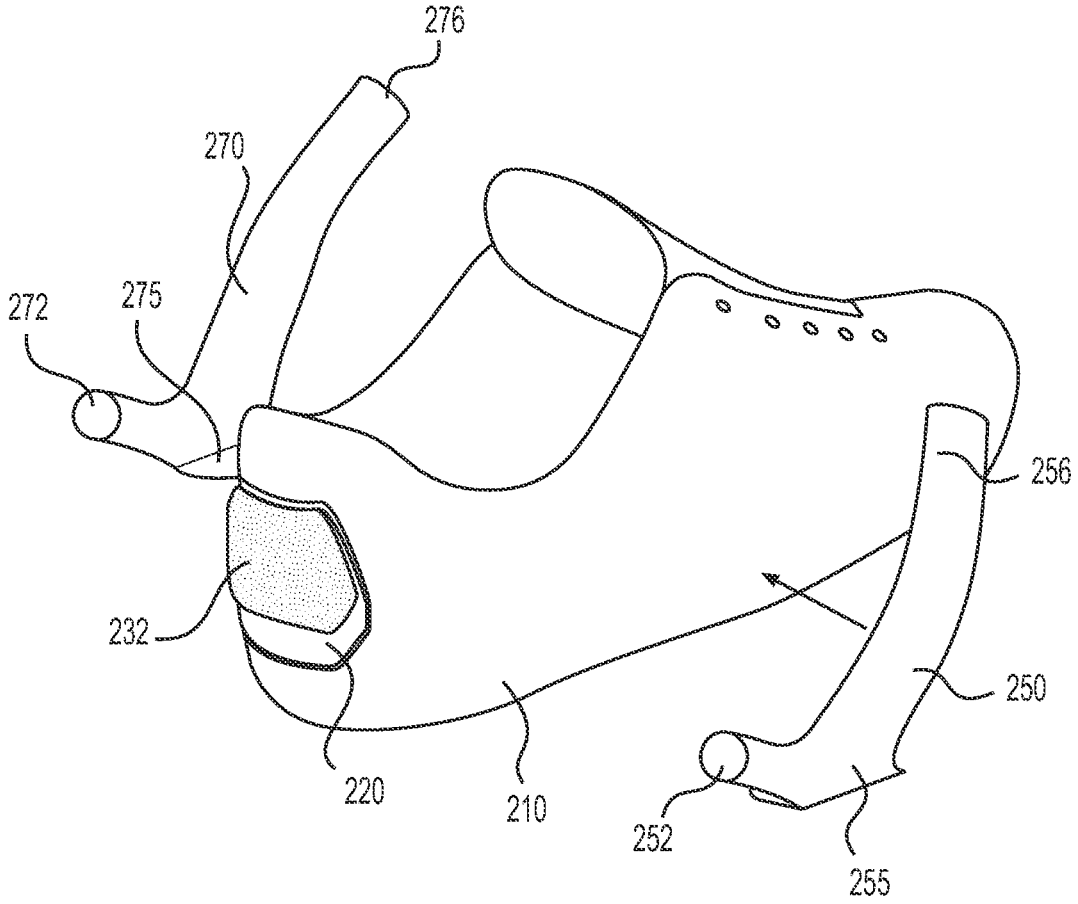

FIGS. 15-20 depict various steps in a method of manufacturing footwear 10. In this method, base element 210, fluid-filled chamber 220, adjusting element 230, anchoring elements 250, and tensile strand 260 are provided. In FIG. 15, fluid-filled chamber 220 is positioned against and secured to base element 210. In FIG. 16, inward-facing portion 232 of adjusting element 230 is positioned outward from fluid-filled chamber 220 and secured to chamber 220. Protrusions 236 and indentations 237 on the inward-facing portion 232 of adjusting element 230 conform, respectively, to indentations 227 and protrusions 226 on the outward-facing portion 221 of chamber 220. In FIG. 17, anchoring element 250 is secured to base element 210 at a position spaced from inward-facing portion 232 of adjusting element 230.

Figure 18:
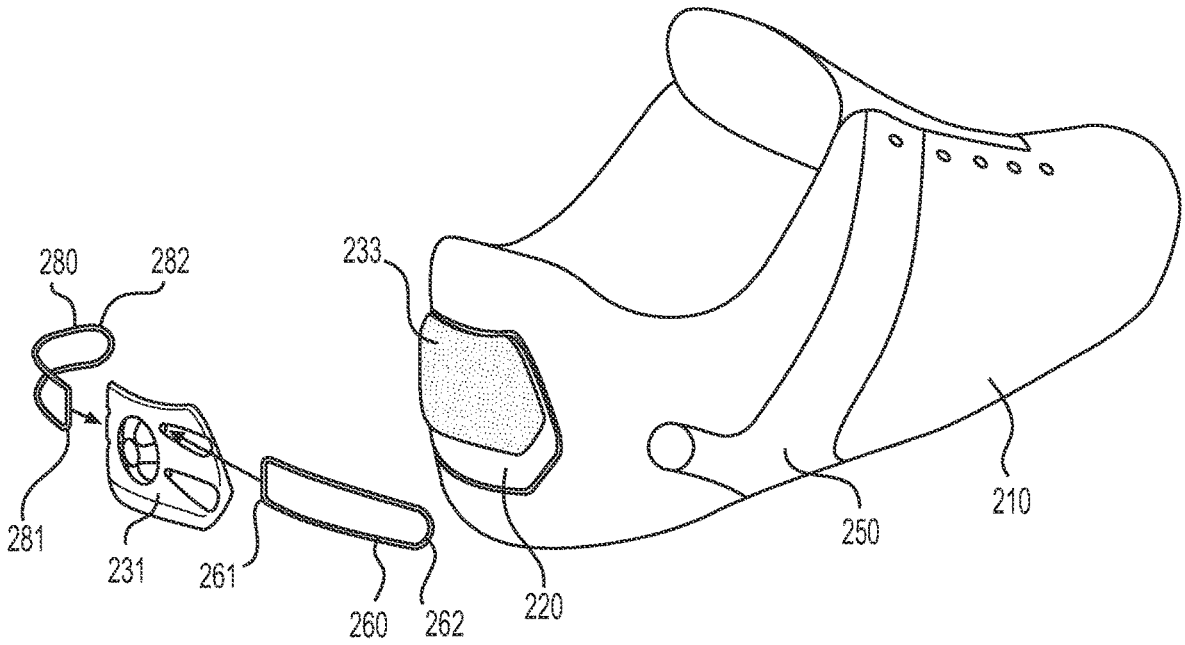
Figure 19:
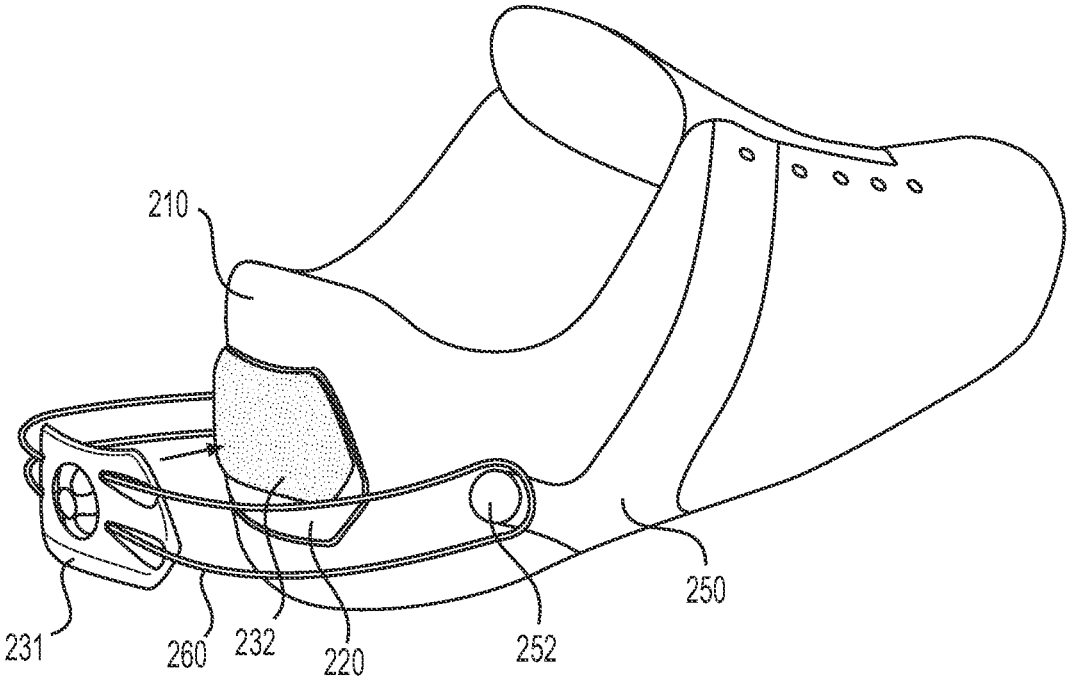
Figure 20:
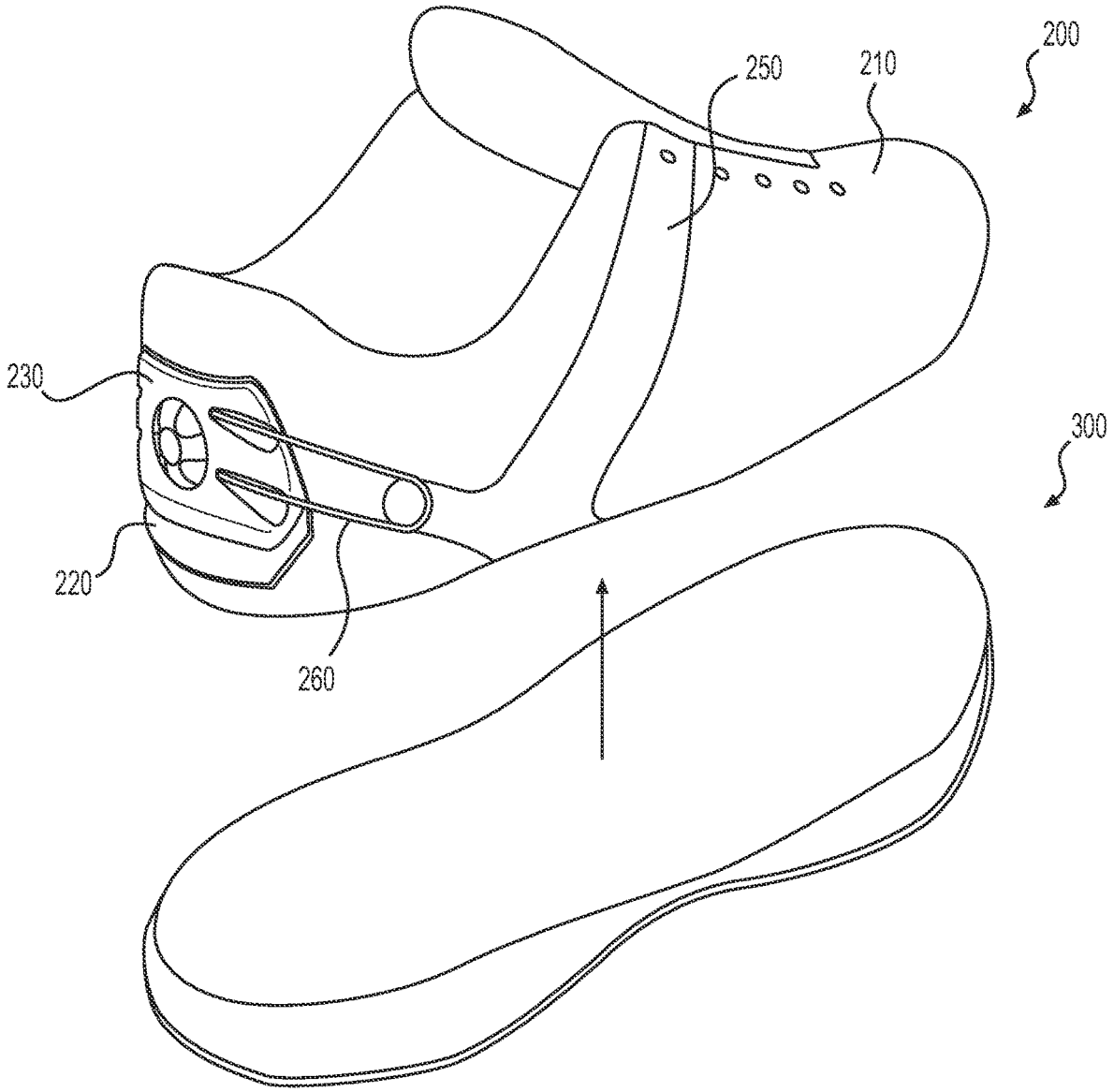

In FIG. 18, tensile strand 260 is positioned to extend between adjusting element 230 and anchoring element 250. More particularly, one end of tensile strand 260 is extended through channels 239 in outward-facing portion 231 of adjusting element 230 and is secured to spool portion 241 within ratchet structure 240, while the other end of tensile strand 260 is positioned within guide channel 253 in connecting portion 252 of anchoring element 250. In FIG. 19, outward-facing portion 231 of adjusting element 230 is secured to inward-facing portion 232 of adjusting element 230 to complete upper 200. Accordingly, one end of tensile strand 260 is positioned within ratchet structure 240, while the other end of tensile strand 260 is positioned within anchoring element 250. Finally, in FIG. 20, sole structure 300 is attached to upper 200 to form footwear 10.

In similar fashion, the method depicted in FIGS. 15-20 may be employed to incorporate additional anchoring element 270 and additional tensile strand 280 into footwear 10. Specifically, in FIG. 17, additional anchoring element 270 is secured to base element 210 at a position spaced from inward-facing portion 232 of adjusting element 230. In FIG. 18, additional tensile strand 280 is positioned to extend between adjusting element 230 and additional anchoring element 270. One end of tensile strand 280 through channels 239 in outward-facing portion 231 of adjusting element 230, and is secured to spool portion 241 within ratchet structure 240, while the other end of tensile strand 280 is positioned within guide channel 273 in connecting portion 272 of anchoring element 270. Accordingly, in FIG. 19, one end of tensile strand 280 is positioned within ratchet structure 240, while the other end of tensile strand 280 is positioned within anchoring element 270.

Further Configurations

Figure 21:
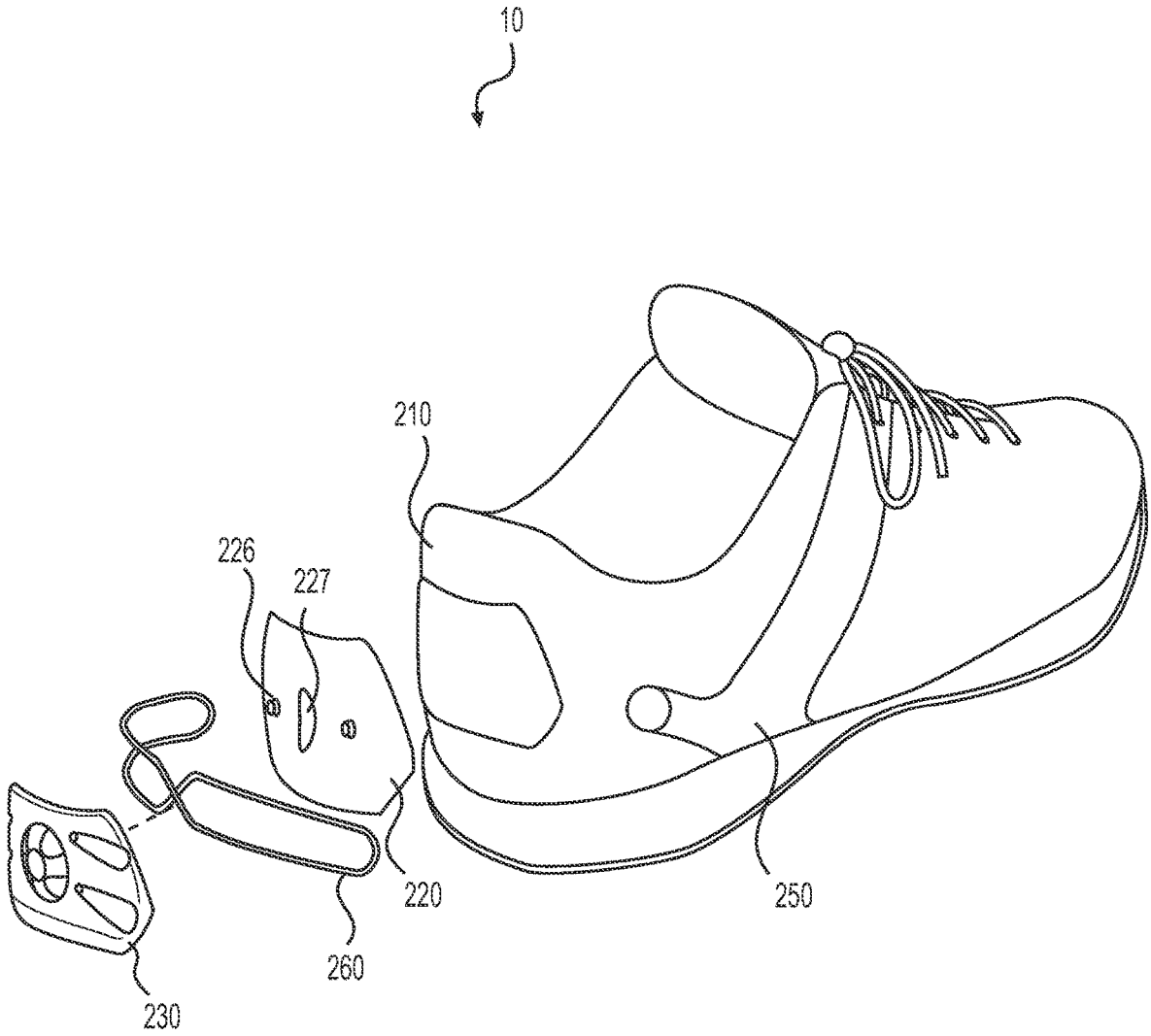
FIGS. 21-22 are lateral side perspective views corresponding with FIG. 1 and depicting further configurations of the article of footwear.

In FIGS. 1-6, upper 200 is depicted as including a tensile strand 260 positioned on lateral side 15 of footwear 10 and an additional tensile strand 280 positioned on medial side 14 of footwear 10, and strands 260 and 280 are depicted as loops. Other configurations of tensile footwear 10 may incorporate other tensile strands 260, and in other ways. For example, FIG. 21 depicts a configuration of footwear 10 having a single tensile strand 260 extending into anchoring element 250 and secured to spool portion 241 of ratchet structure 240. In further configurations, strands 260 and 280 may not be loops, but may single, linear strands with first ends secured to adjusting element 230 and second ends secured to anchoring elements 250 and 270.

Figure 22:
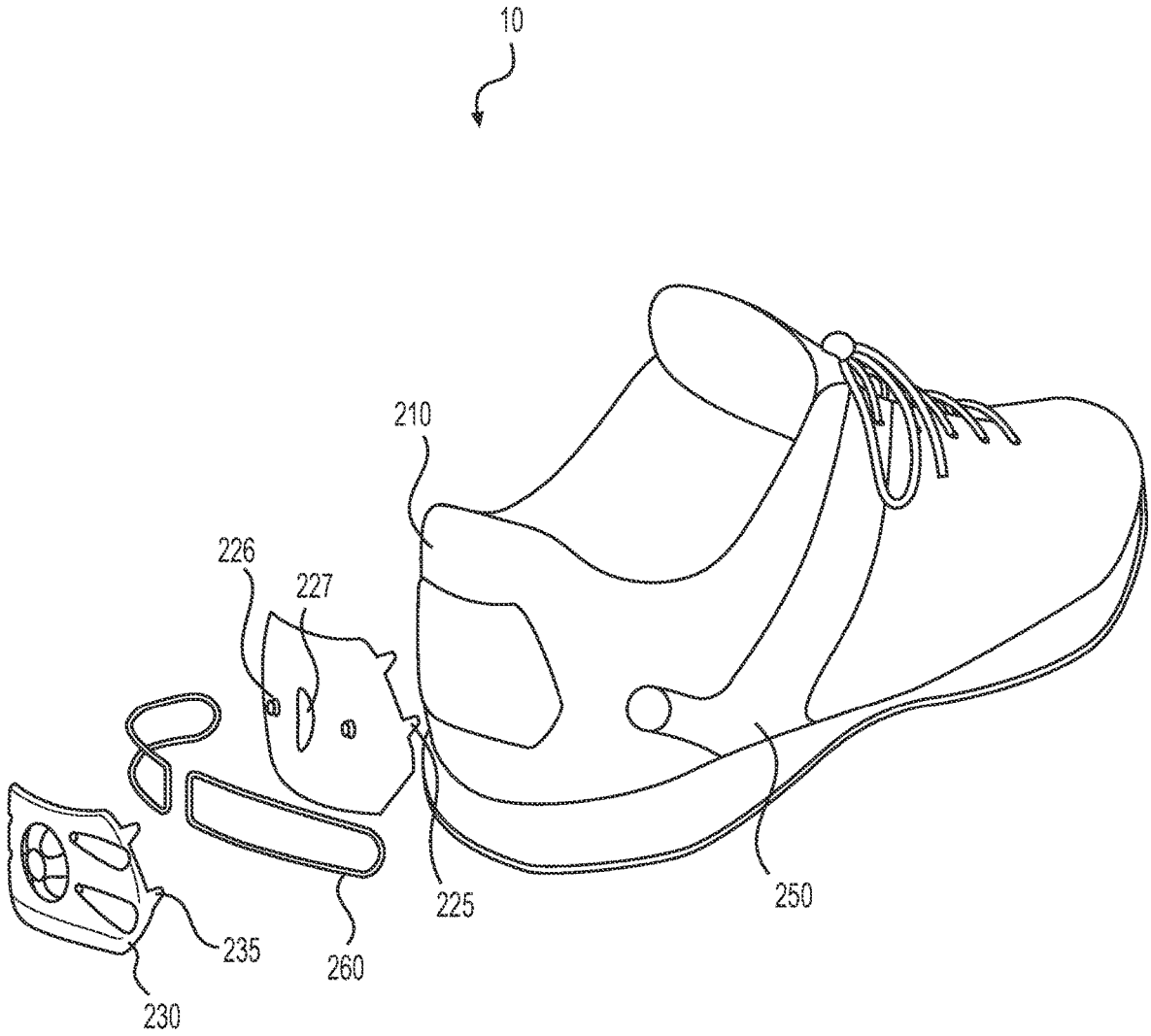

FIGS. 1-6 depict fluid-filled chamber 220 as being secured against an exterior surface of base element 210, and depict adjusting element 230 as being secured against chamber 220. FIG. 22 depicts another configuration of footwear 10, in which fluid-filled chamber 220 is formed to include tab portions 225, and adjusting element 230 is formed to include tab portions 235. Tab portions 225 of chamber 220 and tab portions 235 of adjusting element 230 may extend within or underneath parts of base element 210, in order to better secure chamber 220 and adjusting element 230 against base element 210.

Figure 25:
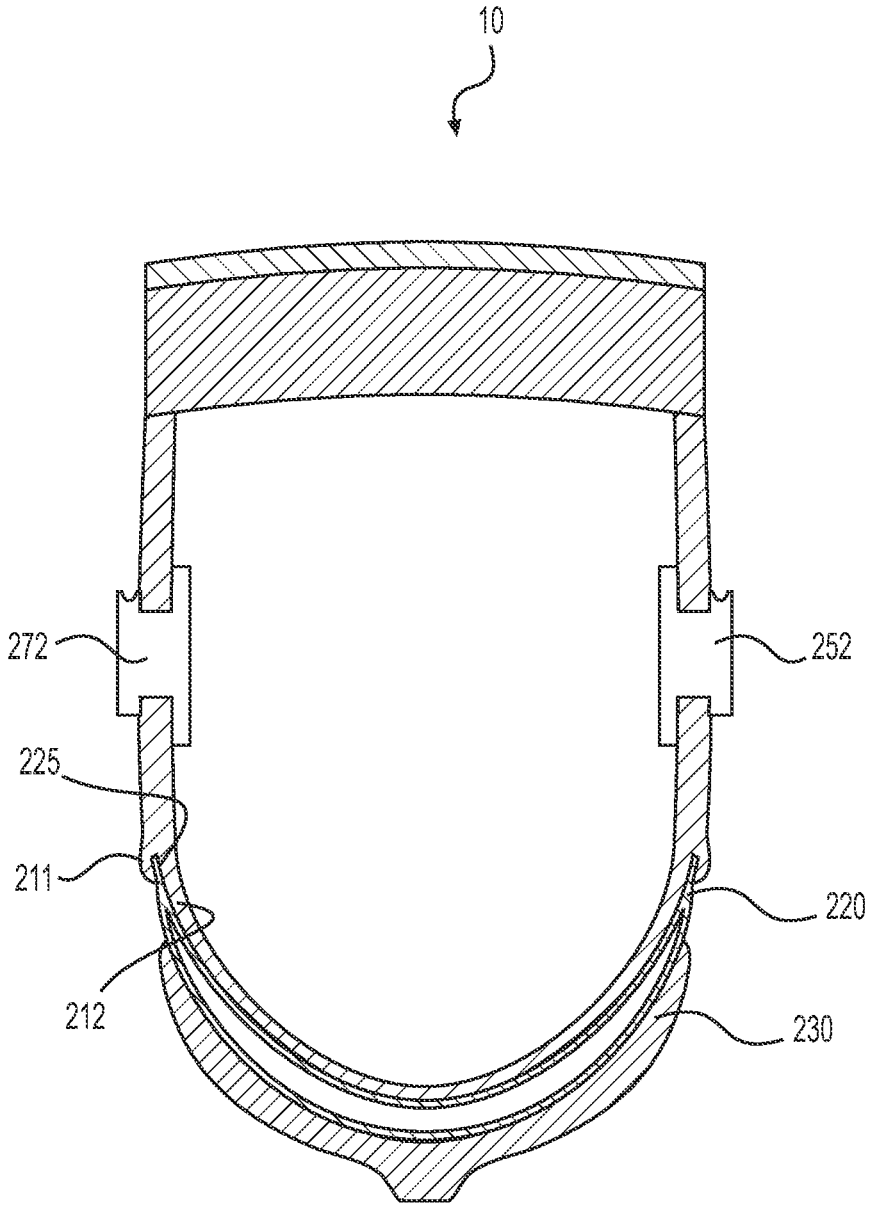
FIGS. 25-28 are cut-away views corresponding with FIG. 6 and depicting further configurations of the article of footwear.

For example, in the configuration depicted in FIG. 25, base element 210 has both an outer portion 211 and an inner portion 212, and tab portions 225 of chamber 220 are depicted as being positioned within base element 210, between outer portion 211 and inner portion 212. In such configurations, base element 210 may be a unitarily formed, single-piece element (such as a foam element, a polymer element, or a knitted textile element), and inner portion 212 of base element 210 may directly contact at least one of adjusting element 230, anchoring element 250, or tensile strand 260.

Figure 26:
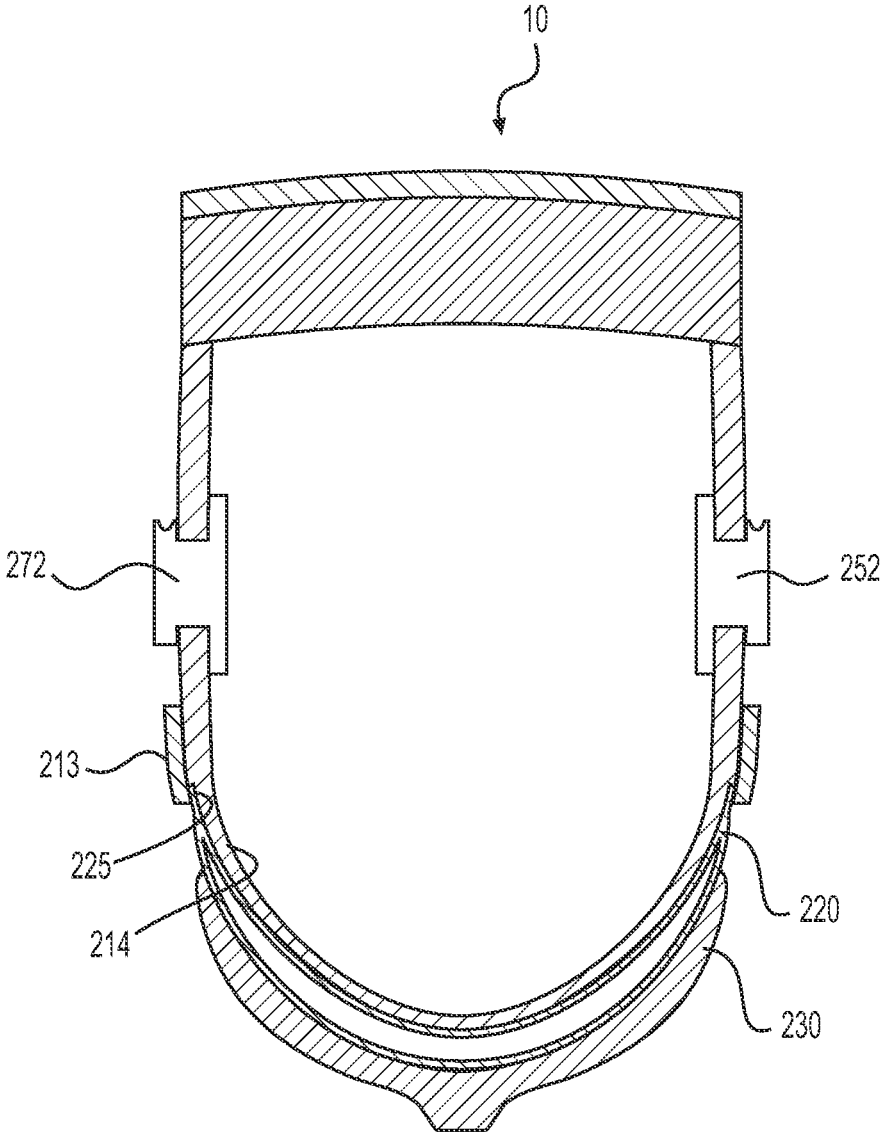

In contrast, FIG. 26 depicts another exemplary configuration in which base element 210 includes an outer layer 213 and an inner layer 214, and tab portions 225 are positioned between outer layer 213 and inner layer 214. In such configurations, base element 210 may be a non-unitarily formed element having multiple material layers, and inner layer 214 may directly contact at least one of adjusting element 230 and anchoring element 250.

Figure 27:
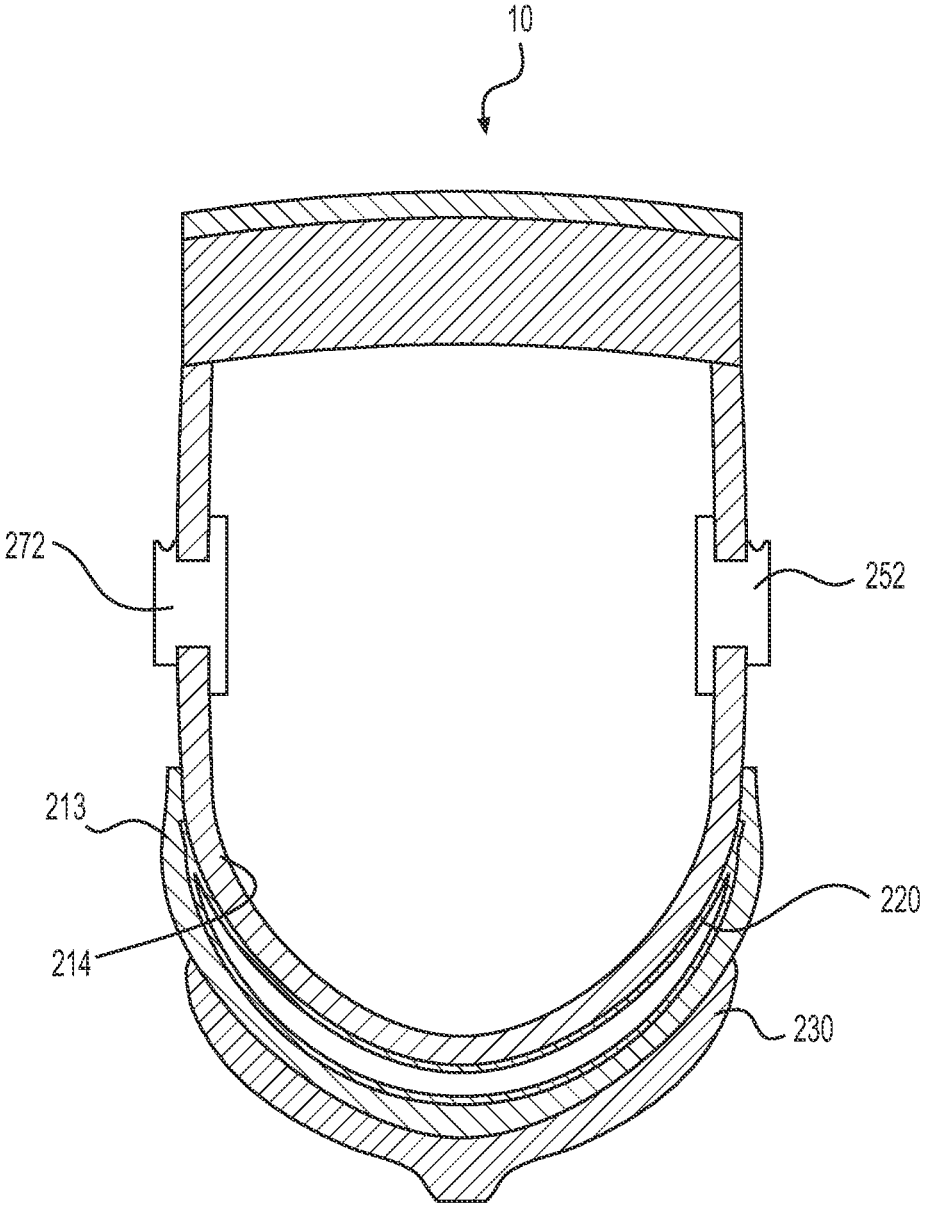
Figure 28:
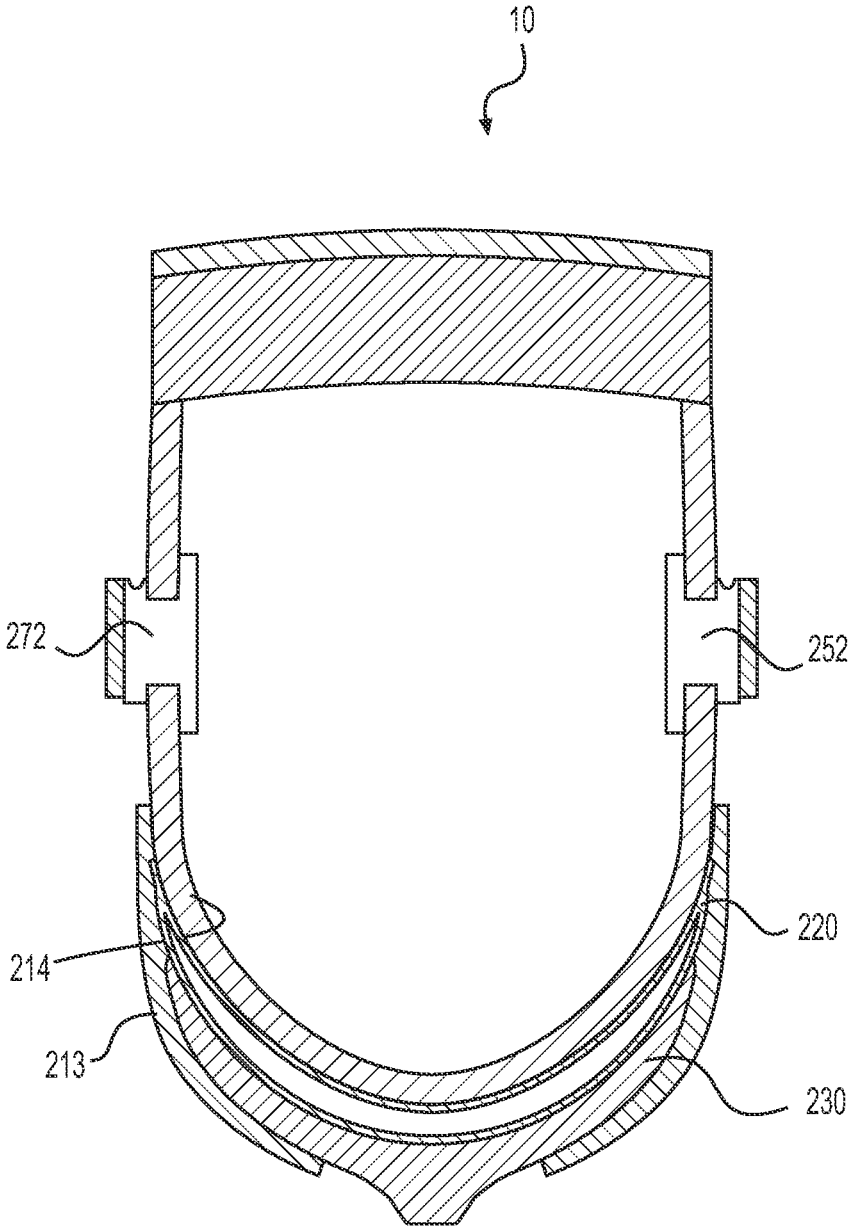

FIG. 27 depicts another configuration in which outer layer 213 of base element 210 extends entirely between fluid-filled chamber 220 and adjusting element 230. In yet another configuration, FIG. 28 depicts outer layer 13 of base element 210 as (a) covering portions of anchoring element 250 and connecting portion 252, (b) extending entirely over chamber 220 and (c) extending almost entirely over adjusting element 230, leaving dial element 238 accessible by a wearer. Accordingly, in various configurations, base element 210 may partially cover one or more of fluid-filled chamber 220, adjusting element 230, anchoring element 250, and tensile strand 260.

Figure 23:
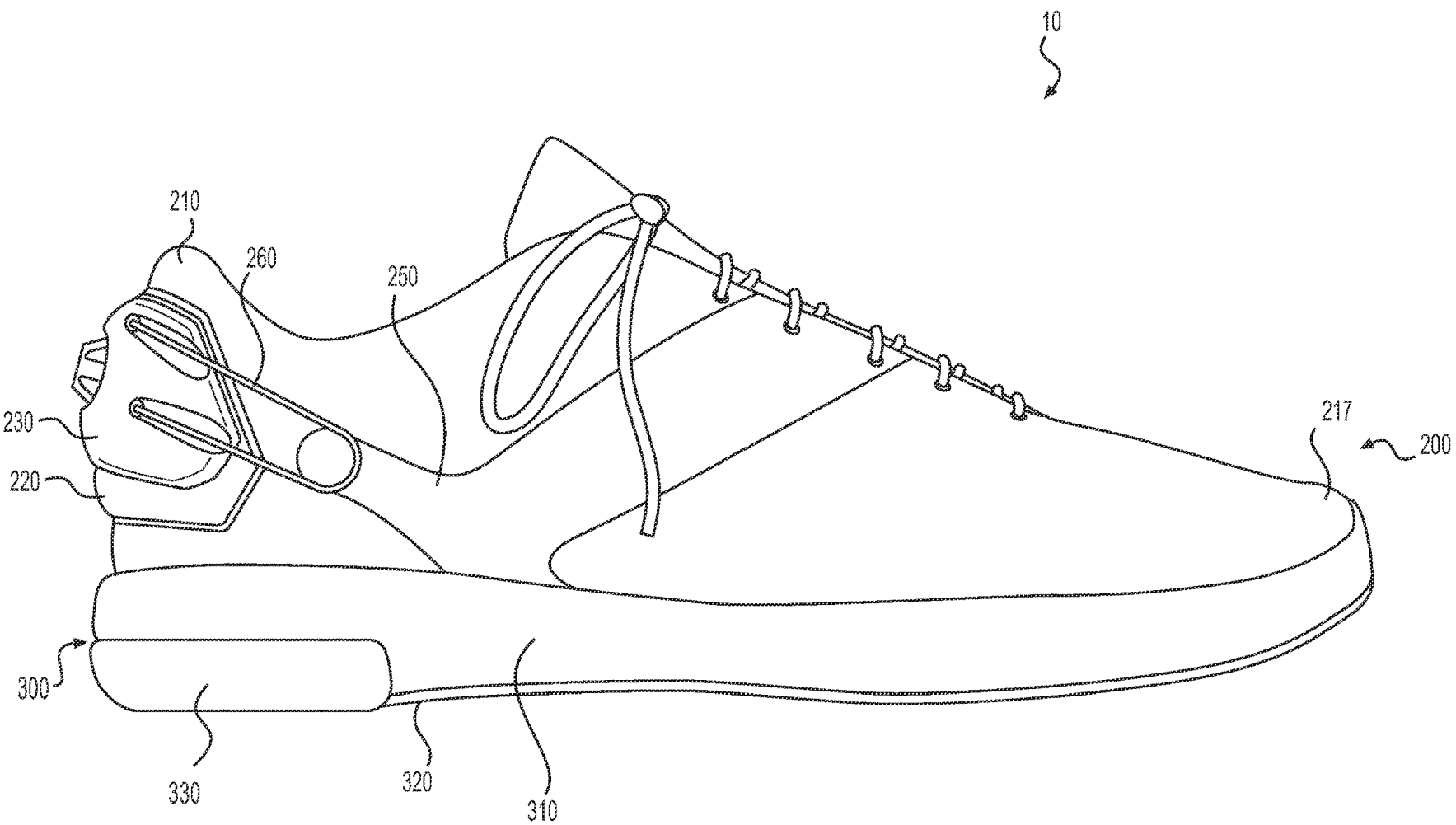
FIG. 23 is a lateral side elevational view corresponding with FIG. 3 and depicting a further configuration of the article of footwear.

Although FIGS. 1-6 depict a single fluid-filled chamber 220, other configurations of footwear 10 are possible. For example, FIG. 23 shows a configuration in which an additional fluid-filled chamber 330 is positioned in heel region 13 and forms part of a ground-contacting surface of sole structure 300. In some configurations, additional fluid-filled chamber 330 may be in fluid communication with fluid-filled chamber 220, while in other configurations, additional fluid-filled chamber 330 may not be in fluid communication with fluid-filled chamber 220.

Figure 24:
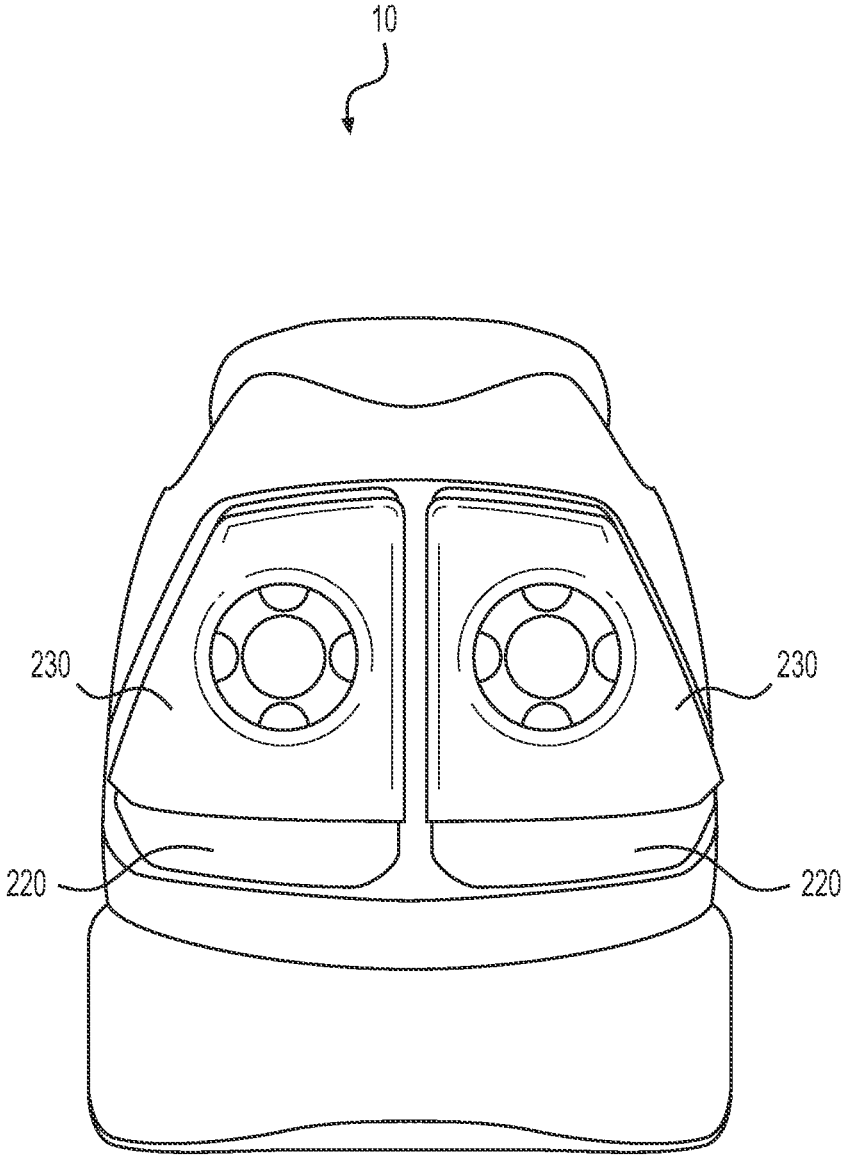
FIG. 24 is a rear elevational view corresponding with FIG. 5 and depicting a further configuration of the article of footwear.

In another exemplary embodiment, FIG. 24 depicts footwear 10 as including two fluid-filled chambers 220 and two adjusting elements 230. Accordingly, in various configurations, footwear 10 may include one or more fluid-filled chambers 220, and footwear 10 may include one or more adjusting elements 230.

Figure 29:
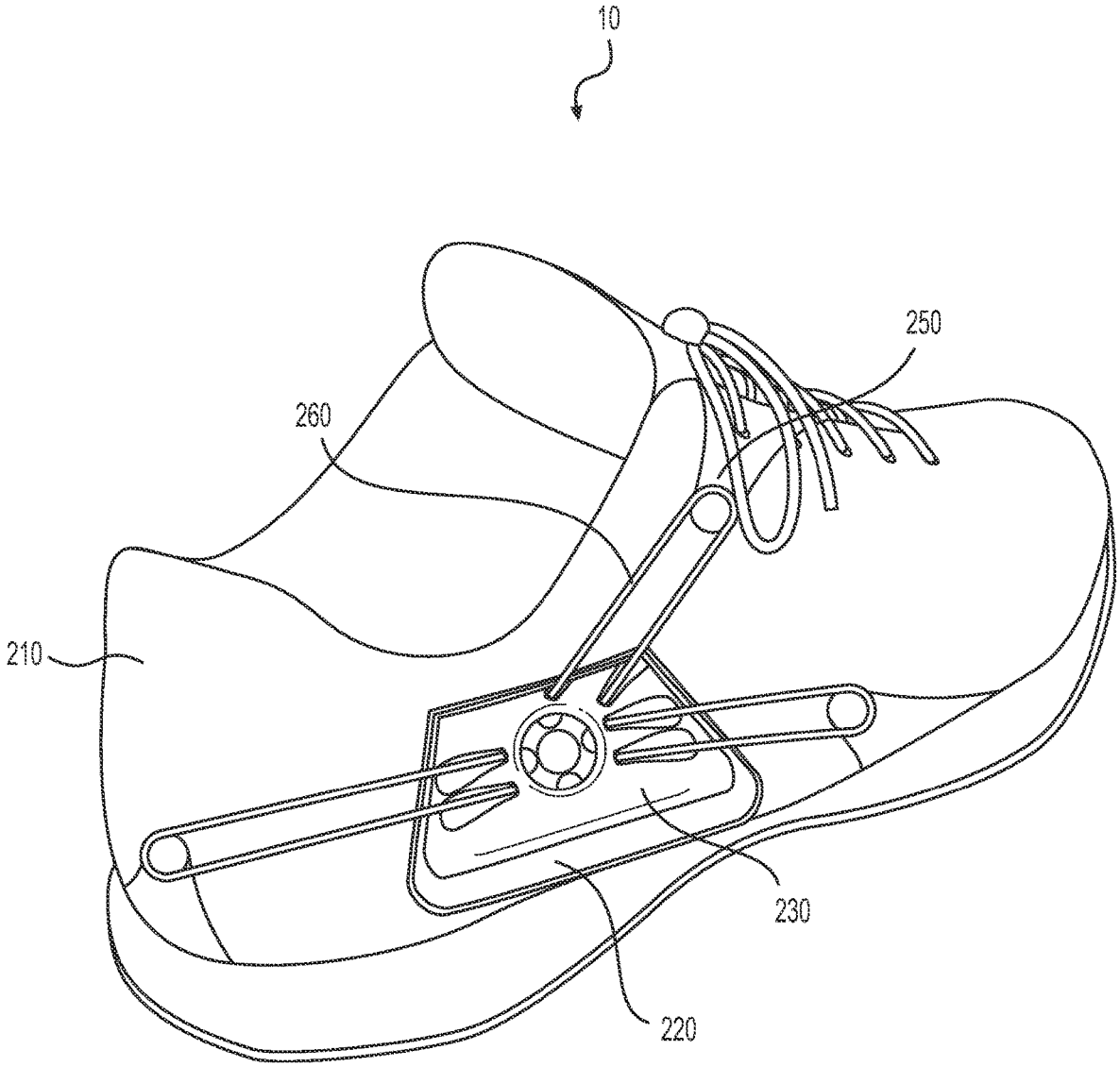
FIGS. 29-32 are lateral side perspective views corresponding with FIG. 1 and depicting further configurations of the article of footwear.
Figure 30:
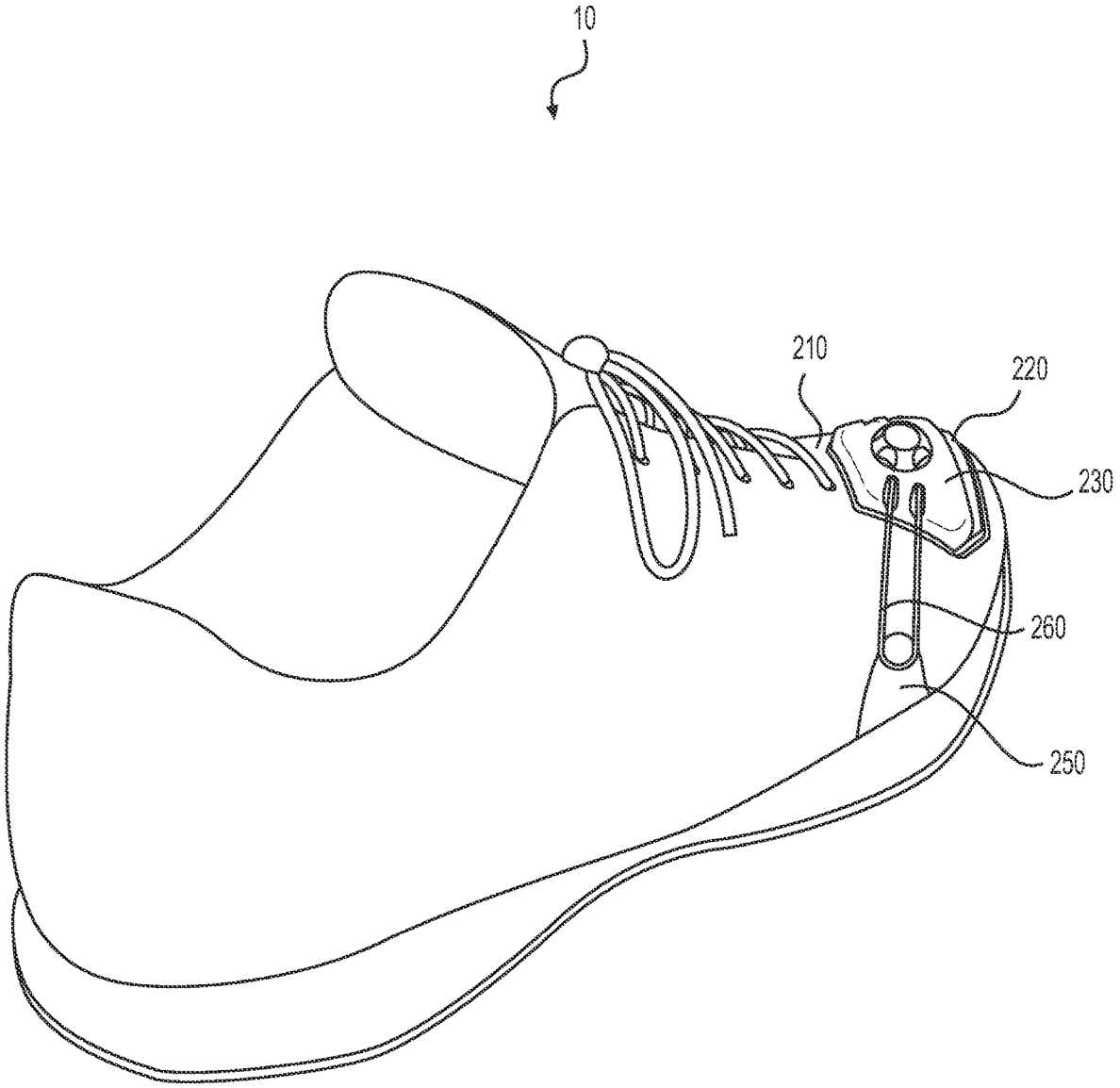

FIGS. 1-6 depict a configuration of the adjustment system in which fluid-filled chamber 220 and adjusting element 230 are positioned in heel region 13 of footwear 10 and anchoring element 250 is positioned in front of adjusting element 230. Other configurations of the adjustment system are possible. For example, FIG. 29 depicts a first exemplary configuration in which chamber 220 and adjusting element 230 are positioned on lateral side 15 and in midfoot region 12 of footwear 10, and anchoring elements 250 are spaced from adjusting element 230 in lace area 216, forefoot region 11, and heel region 13. In another example, FIG. 30 depicts a configuration in which chamber 220 and adjusting element 230 are positioned in toe area 217 of footwear 10, and anchoring elements 250 are spaced from adjusting element 230 on medial side 14 and lateral side 15 of forefoot region 11. The adjustment system and its various elements may accordingly be positioned in various locations along base element 210.

Figure 31:
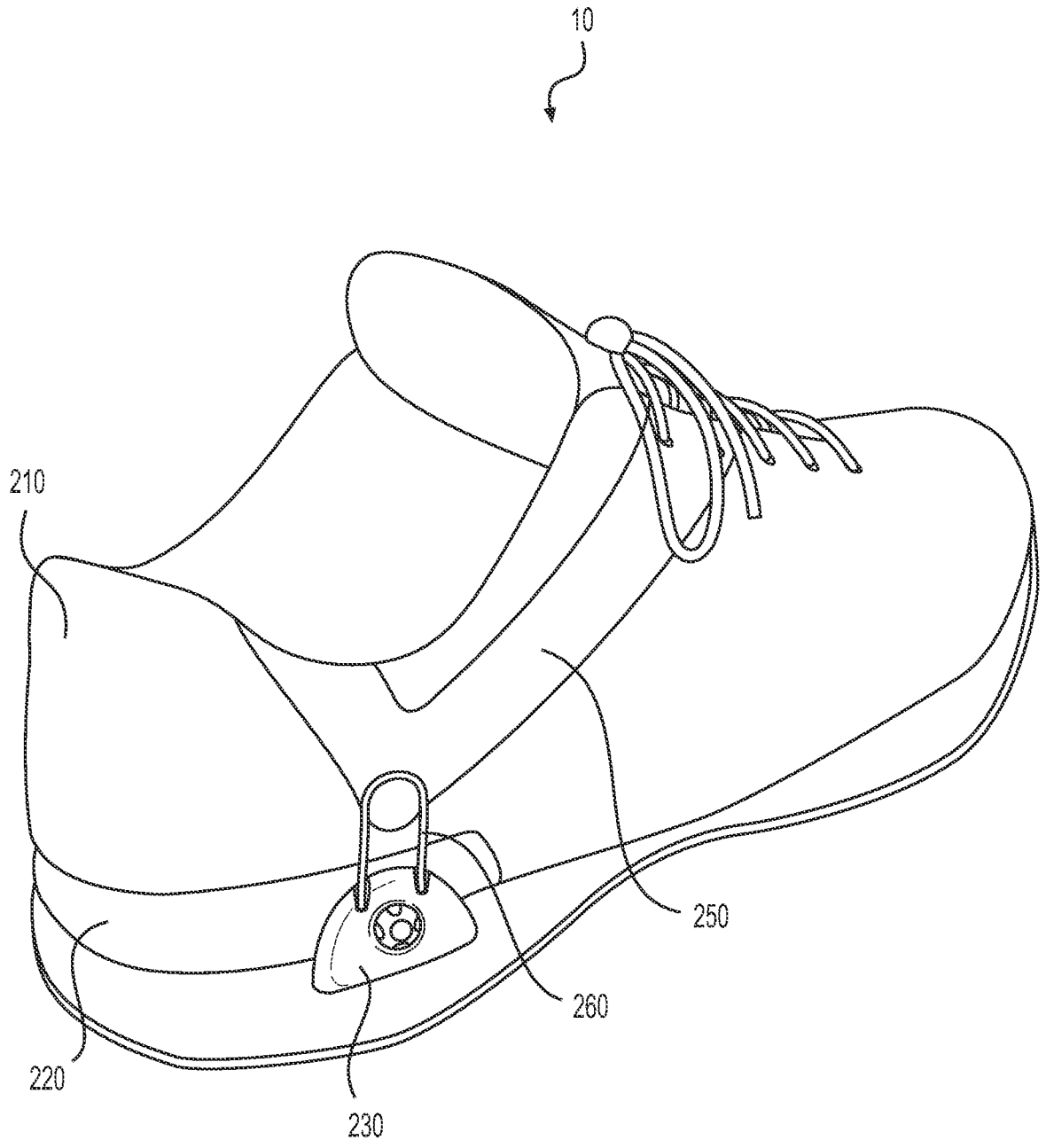
Figure 32:
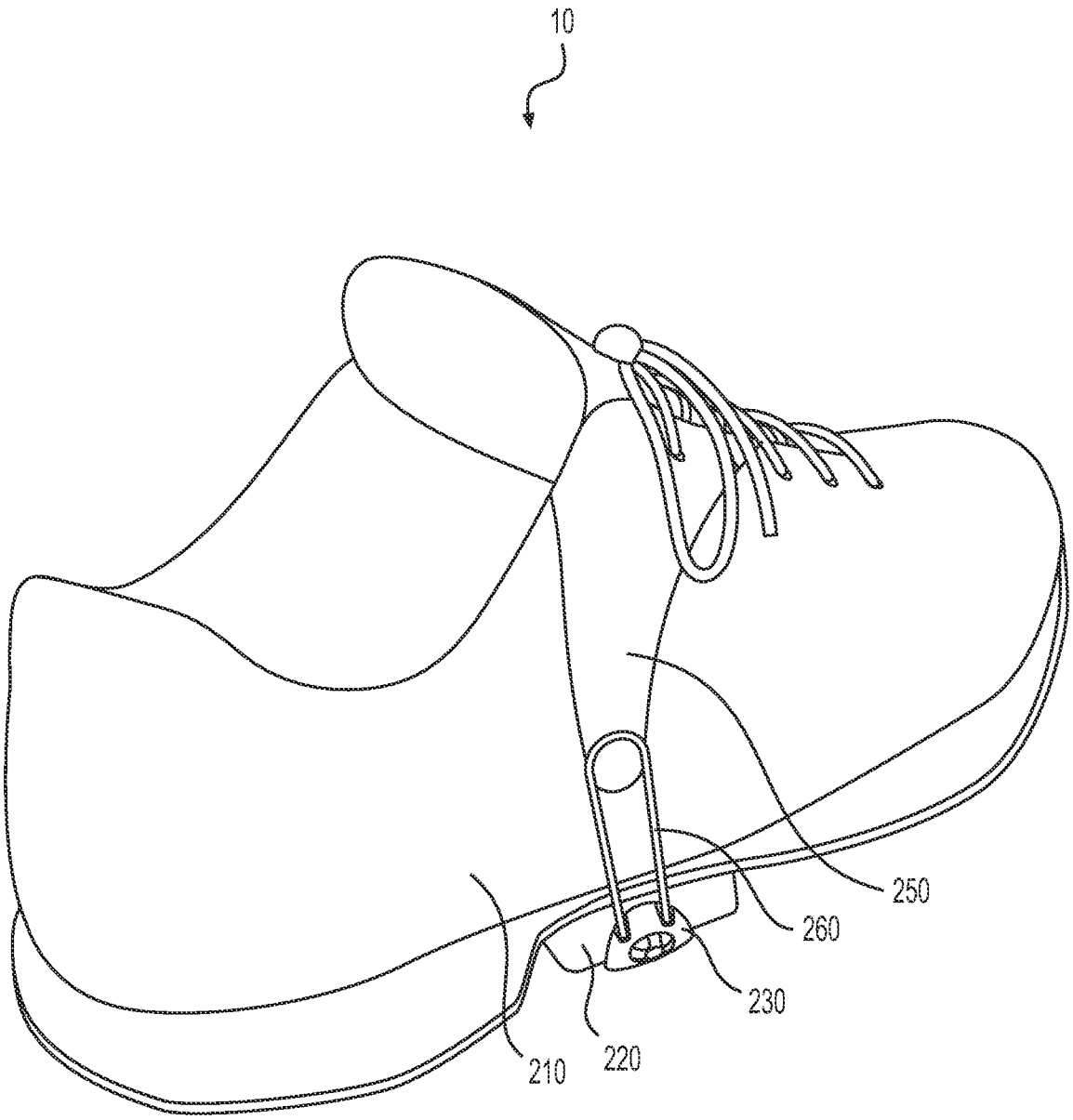

Furthermore, in some configurations, the adjustment system may be positioned in sole structure 300. The exemplary configuration of FIG. 31 depicts fluid-filled chamber 220 and adjusting element 230 as being beneath upper 200, in heel region 13, and anchoring element 250 as being spaced from adjusting element 230 and having portions extending to lace area 216 and an ankle opening area of base element 210. In various configurations of footwear 10, chamber 220 and at least a portion of adjusting element 230 may be adjacent to, partially within, or completely encapsulated by a polymer foam material of midsole 310. Similarly, the exemplary embodiment of FIG. 32 depicts fluid-filled chamber 220 and adjusting element 230 as being beneath both midsole 310 and outsole 320 in midfoot region 12. In various configurations, chamber 220 and at least a portion of adjusting element 230 may be adjacent to or beneath midsole 310 and outsole 320 in any region or regions of footwear 10. Chamber 220 may accordingly be positioned in various locations along upper 200, in midsole 310, or in outsole 320.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

an upper;

a first anchor secured to one of a medial side of the upper and a lateral side of the upper and including a first segment having a first end and an opposing second end with a longitudinal axis of the first segment extending between the first end and the second end, the first end affixed directly to a biteline of the upper, the first segment extending from the biteline in a direction toward a posterior end of the upper, the opposing second end being spaced apart from and rearward of the first end, the first segment including a first projection at the opposing second end of the first segment and extending in a direction away from an outer surface of the first segment;

a fluid-filled chamber spaced apart from the first anchor and including an inward-facing portion opposing the upper and an outward-facing portion disposed on an opposite side of the fluid-filled chamber from the inward-facing portion;

an adjuster opposing the outward-facing portion of the fluid-filled chamber; and a first cable extending between the adjuster and the first projection, the adjuster operable to selectively shorten an effective length of the first cable to compress the fluid-filled chamber between the adjuster and the upper.

2. The article of footwear of claim 1, wherein the first anchor further comprises a second segment extending in a direction away from the biteline and toward a forefoot region of the upper.

3. The article of footwear of claim 2, wherein the second segment includes at least one aperture located proximate to a distal end of the second segment.

4. The article of footwear of claim 3, wherein the upper includes a plurality of apertures operable to receive a lace, the at least one aperture of the second segment being aligned with an aperture of the plurality of apertures and adapted to receive a portion of the lace within the at least one aperture of the second segment and the aperture of the plurality of apertures.

5. The article of footwear of claim 1, wherein the first projection is circular.

6. The article of footwear of claim 1, wherein the first projection includes a channel operable to slidably receive a portion of the first cable.

7. The article of footwear of claim 1, further comprising a second anchor secured to the other of the medial side of the upper and the lateral side of the upper and including a first segment extending from the biteline of the upper in a direction toward a heel region of the upper, the first segment of the second anchor including a second projection extending in a direction away from an outer surface of the first segment of the second anchor.

8. The article of footwear of claim 7, further comprising a second cable extending between the adjuster and the second projection, the adjuster operable to selectively shorten an effective length of the second cable to compress the fluid-filled chamber between the adjuster and the upper.

9. The article of footwear of claim 1, wherein the fluid-filled chamber extends along a heel region of the upper from the medial side to the lateral side.

10. An article of footwear comprising:

an upper;

a first anchor secured to one of a medial side of the upper and a lateral side of the upper and including a first segment having a first end and an opposing second end with a longitudinal axis of the first segment extending between the first end and the second end, the first end affixed directly to a biteline of the upper, the opposing second end being spaced apart from and rearward of the first end, the first segment extending in a direction toward a posterior end of the upper and a second segment extending in a direction away from the first segment toward an anterior end of the upper, the first segment including a first projection at the opposing second end of the first segment and extending in a direction away from an outer surface of the first segment;

a fluid-filled chamber spaced apart from the first anchor and including an inward-facing portion opposing the upper and an outward-facing portion disposed on an opposite side of the fluid-filled chamber from the inward-facing portion;

an adjuster opposing the outward-facing portion of the fluid-filled chamber; and a first cable extending between the adjuster and the first projection, the adjuster operable to selectively shorten an effective length of the first cable to compress the fluid-filled chamber between the adjuster and the upper.

11. The article of footwear of claim 10, wherein the second segment extends from the biteline of the upper.

12. The article of footwear of claim 11, wherein the second segment includes at least one aperture located proximate to a distal end of the second segment.

13. The article of footwear of claim 12, wherein the upper includes a plurality of apertures operable to receive a lace, the at least one aperture of the second segment being aligned with an aperture of the plurality of apertures and adapted to receive a portion of the lace within the at least one aperture of the second segment and the aperture of the plurality of apertures.

14. The article of footwear of claim 10, wherein the first projection is circular.

15. The article of footwear of claim 10, wherein the first projection includes a channel operable to slidably receive a portion of the first cable.

16. The article of footwear of claim 10, further comprising a second anchor secured to the other of the medial side of the upper and the lateral side of the upper and including a first segment extending toward a heel region of the upper and a second segment extending in a direction away from the first segment of the second anchor toward a forefoot region of the upper, the first segment of the second anchor including a second projection extending in a direction away from an outer surface of the first segment of the second anchor.

17. The article of footwear of claim 16, further comprising a second cable extending between the adjuster and the second projection, the adjuster operable to selectively shorten an effective length of the second cable to compress the fluid-filled chamber between the adjuster and the upper.

18. The article of footwear of claim 10, wherein the fluid-filled chamber extends along a heel region of the upper from the medial side to the lateral side.

* * * * *